US008789862B2

(12) United States Patent
Liang et al.

(10) Patent No.: US 8,789,862 B2
(45) Date of Patent: Jul. 29, 2014

(54) ADJUSTABLE AFTER-MARKET SASH WINDOW STOP

(75) Inventors: Luke Liang, S. Plainfield, NJ (US); David Chen, Guangzhou (CN)

(73) Assignee: Vision Industries Group, Inc., So. Plainfield, NJ (US)

( * ) Notice: Subject to any disclaimer, the term of this patent is extended or adjusted under 35 U.S.C. 154(b) by 300 days.

(21) Appl. No.: 12/802,640

(22) Filed: Jun. 10, 2010

(65) Prior Publication Data

US 2010/0313488 A1 Dec. 16, 2010

Related U.S. Application Data

(63) Continuation-in-part of application No. 12/456,347, filed on Jun. 15, 2009.

(60) Provisional application No. 61/217,365, filed on May 29, 2009.

(51) Int. Cl.

| | |
|---|---|
| ***E05C 19/00*** | (2006.01) |
| ***E05B 65/08*** | (2006.01) |
| ***E05C 3/14*** | (2006.01) |
| ***E05B 63/00*** | (2006.01) |
| *E05C 7/00* | (2006.01) |
| *E05C 17/60* | (2006.01) |

(52) U.S. Cl.

CPC ..... *E05B 65/0847* (2013.01); *E05C 2007/007* (2013.01); *E05C 17/60* (2013.01); *E05C 3/14* (2013.01); *E05B 63/0056* (2013.01)

USPC ..... 292/300

(58) Field of Classification Search

CPC ... E05B 65/006; E05B 15/0093; E05C 17/50; E05C 17/54

USPC ..... 292/1, 338, 339, 230, 231, 219, 220, 292/DIG. 20, DIG. 31, DIG. 63, 300, 292/DIG. 37; 49/449

See application file for complete search history.

(56) References Cited

U.S. PATENT DOCUMENTS

| | | | | | |
|---|---|---|---|---|---|
| 534,185 | A | * | 2/1895 | Winchester | 292/63 |
| 1,412,154 | A | * | 4/1922 | Wollesen | 292/219 |
| 1,960,034 | A | * | 5/1934 | Stewart | 292/54 |
| 2,480,988 | A | * | 9/1949 | Walton | 292/218 |
| 2,523,559 | A | * | 9/1950 | Couture | 292/67 |
| 2,527,278 | A | * | 10/1950 | Schemansky | 292/194 |
| 2,612,398 | A | * | 9/1952 | Miller | 292/230 |
| 2,670,982 | A | * | 3/1954 | Banham | 292/202 |
| 3,821,884 | A | * | 7/1974 | Walsh | 70/95 |
| 2007/0222234 | A1 | * | 9/2007 | Liang et al. | 292/338 |

* cited by examiner

*Primary Examiner* — Kristina Fulton
*Assistant Examiner* — Nathan Cumar
(74) *Attorney, Agent, or Firm* — Thomas A. O'Rourke; Booner & O'Rourke, LLP

(57) ABSTRACT

An adjustable stop is adapted to limit travel of a sliding sash window/door, and can be installed upon the window/door master frame during initial manufacturing of the product, or may be an after-market option added at some time after manufacturing was completed. The stop may even be installed upon sash windows/doors currently in service in a building. The stop is intended to limit sash travel between a closed position and a safe position, where the safe position is a position significantly less than a full-open position. The safety stop may be comprised of a housing and a tumbler being pivotally mounted within a cavity in the housing, with a spring to bias the tumbler out of an opening in the housing. Mounting is by a flange extending from the housing, with spacers of varying thickness that are capable of removably attaching thereon to accommodate sash to master frame height differences.

45 Claims, 17 Drawing Sheets

21
34
34A
32
29
34
34A
32

21
26
23
22
31A
31B
33
31C
23
28
21
25
30
31
36
24

33
31
37C
21
26
24

31P
23
27
34
21
35
21C
25
26
35
20A
34
27
38
24
22

20

ADJUSTABLE AFTER-MARKET SASH WINDOW STOP

CROSS REFERENCES TO RELATED APPLICATIONS

This application is a continuation-in-part of U.S. patent application Ser. No. 12/456,347, titled "Single Action Vent Stop," filed Jun. 15, 2009, which claims priority on U.S. Provisional Application Ser. No. 61/217,365, filed May 29, 2009, the disclosures of which are hereby incorporated by reference.

FIELD OF THE INVENTION

The present invention relates to improvements in safety latches for sliding sash windows and doors, and more particularly to a safety latch which permits after-market installation on a variety of different window configurations, and is capable of preventing accidental egress of a small child from a window.

BACKGROUND OF THE INVENTION

A sash window or sash door is comprised of a master frame that permits installation into a wall of a home or other building. The master frame is generally arranged to receive at least one sliding member, with the sliding member being in the form of a window or door member that is encased within its own frame. The sliding door or window may contain multiple panes of glass that are separated and supported by muntin bars, or alternatively, a single glazing may be used, to which may be added a decorative artificial muntin grid that simulates the look of the multi-paned window.

Sliding sash windows and doors may be designed to slide horizontally or vertically within the master frame. In addition, sash windows and doors may be provided in the form of a single-hung or a double-hung arrangement. In the single hung arrangement, there may be one sash window member that is fixed within the master frame and a second sash window member that slides relative to the first sash window member. In the double hung arrangement, both sash window members may be permitted to slide relative to the master frame.

Historically, these sliding sash windows were provided with a single latching mechanism, which permitted a person to lock the window in a closed position, or to unlock the window and permit free movement of a sash from one end of the master frame to the other end of the master frame. Safety concerns, in terms of preventing the unauthorized entry of burglars through open windows or other intruders threatening the security of occupants, has led to the introduction of a secondary latching mechanism on many new windows that may be deployed to selectively limit the travel of the sash, once the primary latch has been toggled to unlock the window sashes. One example is shown by U.S. Pat. No. 6,854,214 to Polowinczak for "Stop for a Slidable Window." This sash window stop, and other similar stops, is designed to be disposed within a cavity in the manufactured sash window frame, whereby a portion of the stop may be toggled to protrude outward and limit the travel of a sash.

The drawback for these window stops is that they are not conducive for after-market installation into a sash window. The window stop disclosed herein provides a unique means of installing such a travel limiting latch onto an existing sash window. The stop herein does not require creation of a cavity in the sash window frame, and may furthermore be easily modified to accommodate various different sash window configurations.

OBJECTS OF THE INVENTION

It is an object of the invention to provide a means of preventing accidental egress of a child out of a sliding sash window or sash door.

It is an object of the invention to provide a travel limiting stop for a sliding sash window or sash door.

It is another object of the invention to provide a sliding sash window stop that may be installed onto a window after manufacturing of the window is completed.

It is a further object of the invention to provide a sliding sash window stop that may be easily installed onto a window that is already in use in a building.

It is another object of the invention to provide a window stop that may be installed onto many different sash window configurations.

It is also an object of the invention to provide a means of quickly adjusting the stop to accommodate different depths of sash window insets within a master window frame.

Further objects and advantages of the invention will become apparent from the following description and claims, and from the accompanying drawings.

SUMMARY OF THE INVENTION

The after-market safety stop disclosed herein is intended for attachment to a master frame of a sliding sash window assembly or a sliding sash door assembly, to be capable of limiting sash travel between a closed position and a safe position, where the safe position is a sash position between the closed sash position and a full-open sash position. The safe position may be established to permit sash movement sufficient for ventilation, but be small enough to prevent window sash travel of a magnitude that would allow a small child to accidentally fall out of the opened window. The safety stop may be attached to older windows already installed in a building, because they lack such a stop, or even where they have a safety stop, but it permits travel that is excessive or insufficient in comparison with the needs of the occupant.

The safety stop may be comprised of a multi-walled housing that has a cavity and several openings. A tumbler may be pivotally disposed into the housing cavity, with a portion of the first end of said tumbler protruding out from said one opening in the housing top end, and with the tumbler pivoting at a point between its first end and second end.

The tumbler may be biased by a biasing member, which may essentially be a torsion having arms that are adapted to be held within the housing and the tumbler. The biasing member may be set to bias the tumbler to pivot out from the housing cavity. The tumbler may also be capable of occupying four different positions, two of which may be considered to be transient positions. The tumbler may be placed in a first position, where a tumbler bearing surface may limit movement of a sash member between a closed position and a safe position, or in a second position, where the sash member be able to move past the tumbler, by deflecting the tumbler into an intermediate position, where it may be retained until the sash member is moved back towards the closed past enough to be clear of the safety stop. The tumbler may occupy a second transient position—a retracted position, when the tumbler is toggled between the first and second position.

A mounting flange may be integral to the housing, and protruding outward therefrom, at a position between a top end and a bottom end of the housing, with the mounting flange being generally parallel to the housing bottom end, but offset therefrom by a certain amount. The mounting flange may comprise two or more orifices usable for mounting the safety stop to the sash window or door.

The bottom surface of the mounting flange may also contain two or more orifices for receiving two or more posts to attach a spacer block to the safety stop. The spacer block may be capable of nesting within the mounting flange bottom surface, and may remain therein because of a friction fit between the posts and orifice. Alternatively, the posts may snap into the orifices through the use of a detent. The spacer blocks may have a thickness to adjust for variations in a height difference between said sliding sash and said master frame. Using different thicknesses for the spacer and combinations of different spacers may permit accommodation of for various manufacturers of a sliding sash window assembly or a sliding sash door assembly.

DETAILED DESCRIPTION OF THE INVENTION

Figure 1:
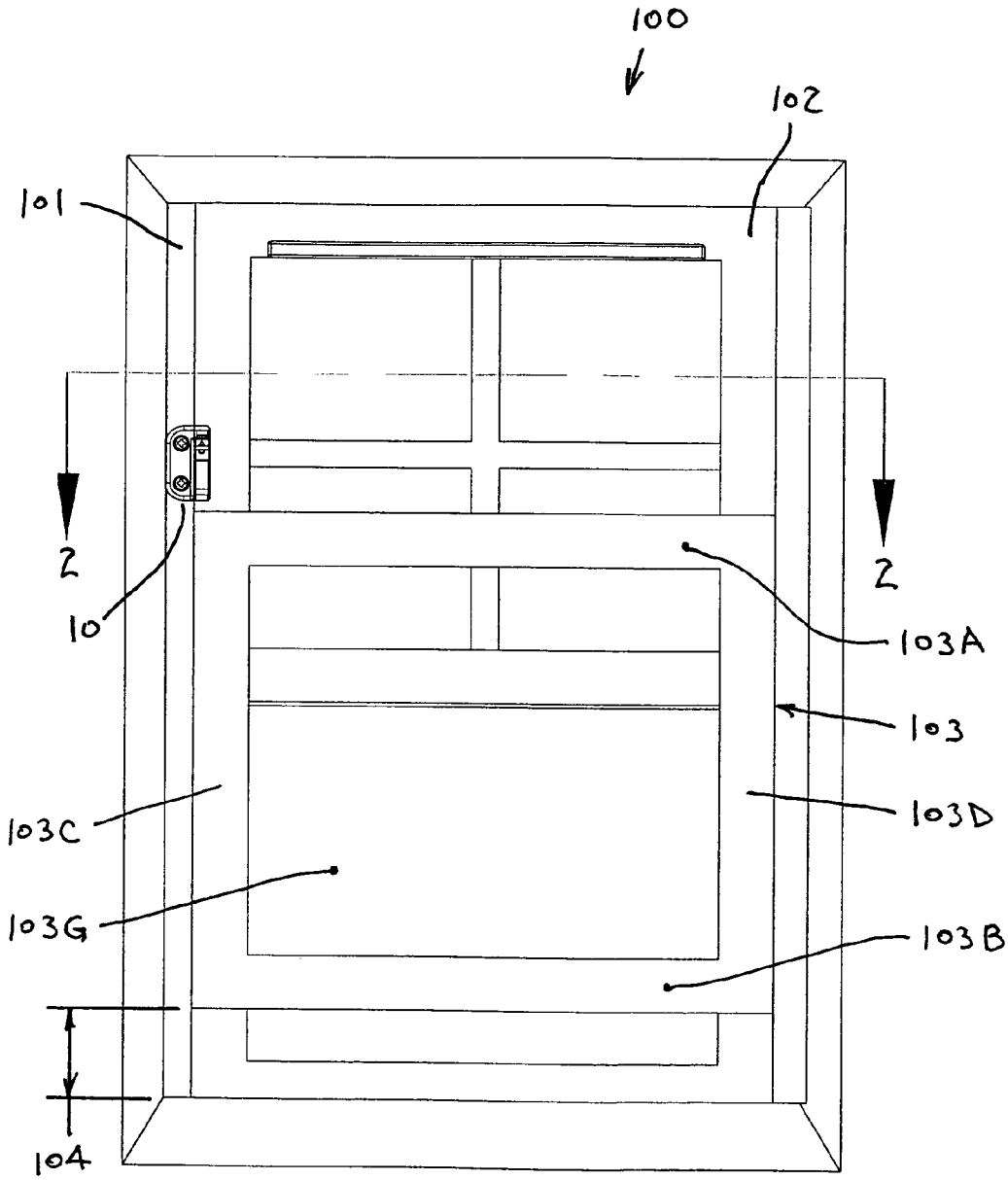
FIG. 1 is a front view of a vertical sliding sash window assembly installed in a building, with the adjustable after-market stop of the current invention installed thereon to limit upward travel of the lower sash window.
Figure 2:
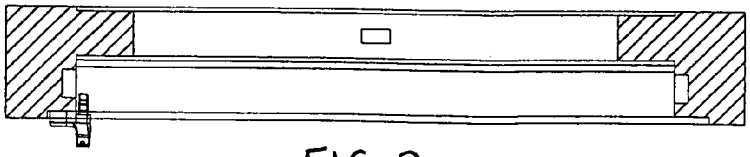
FIG. 2 is a section cut through the sliding sash window and adjustable stop of FIG. 1.
Figure 5:
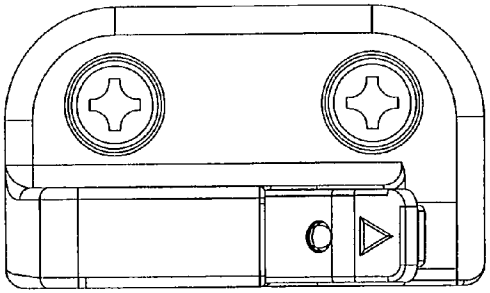
FIG. 5 is a top view of the adjustable window stop of the current invention.

FIG. 5 shows a first embodiment of the adjustable window stop assembly 10 of the present invention, which may be practiced using the adjustable window stop assembly 10 and one or more spacer blocks (80A, 80B, etc) of the same or of varying thickness.

Figure 20:
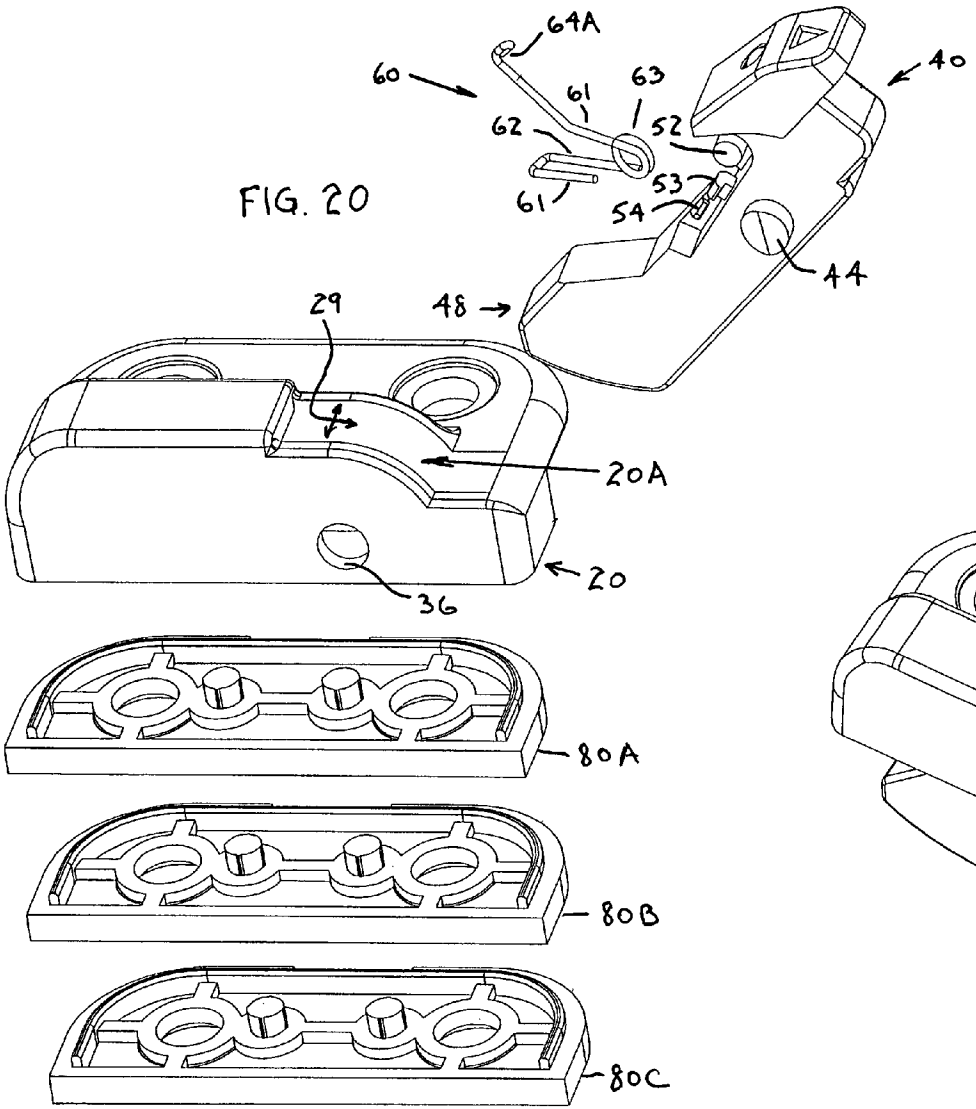
FIG. 20 is an exploded view of the parts comprising the safety stop assembly of the current invention and three spacer blocks.
Figure 21:
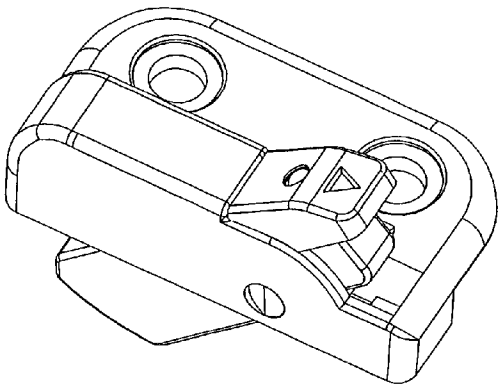
FIG. 21 is the perspective view of FIG. 12.

The window stop assembly 10 may include a housing 20, a tumbler 40, and a biasing member 60, as seen in FIG. 20, the operation of which is disclosed by U.S. patent application Ser. No. 12/456,347, which claims priority on U.S. Provisional Application Ser. No. 61/217,365, filed May 29, 2009, the disclosures of each being incorporated herein by reference. The housing 20 may be constructed to be of many different shapes, and need not resemble the box-like structure of the housing shown in FIGS. 12A through 12E. In fact, the housing could be formed of a single walled member and could resemble half of an egg-shape. It may be formed as one continuous piece, as with a casting or an injection molded plastic part, or it may be an assembly of several wall members that are assembled using mechanical fasteners. Using a box-like formation for the housing results in simplification of several other aspects of the design of the safety stop herein, and is therefore described in one embodiment.

The housing 20 may comprise a top wall 21, a bottom wall 22, a first end wall 23, a second end wall 24, a first (uninterrupted) side wall 25, and a second (interrupted) side wall 26, to create a cavity 20A. The second side wall 25 may have extending therefrom a mounting flange 31, which may be formed integral to the housing, or may be attached thereon using mechanical fasteners or a welding process. The mounting flange 31 may be comprised of a top surface 31A, a bottom surface 31B, and a periphery 31C that may be of a generally rectangular shape, except for a pair of outside corner radii 32. The mounting flange may have two or more mounting holes 34 running completely through the flange, from the upper surface 31A to the lower surface 31B. The holes 34 may additionally have a countersink 34A or a countersink with a recess for accommodating flush-head or pan-head fasteners. Both the top surface 31A and the bottom surface 31B may be flat. However, in an alternate embodiment, the bottom surface 31B may be sculpted to leave behind a padded area 31P in the region around holes 34, as well as a ridge of thickness 38 along the edge. The mounting flange 31 may have one or more additional holes 35 which begin at the bottom surface 31B of the mounting flange 31. The holes 35 may be full depth, or may alternatively only penetrate to a depth being between the bottom surface 31B and the upper surface 31A, so as to improve the visual appearance of the safety stop. These additional holes 35 may be used to receive posts located on the spacer blocks 80A and 80B in a friction fit, which will be discussed hereinafter.

Figures 12A, 12B, 12C, 12D, 12E:
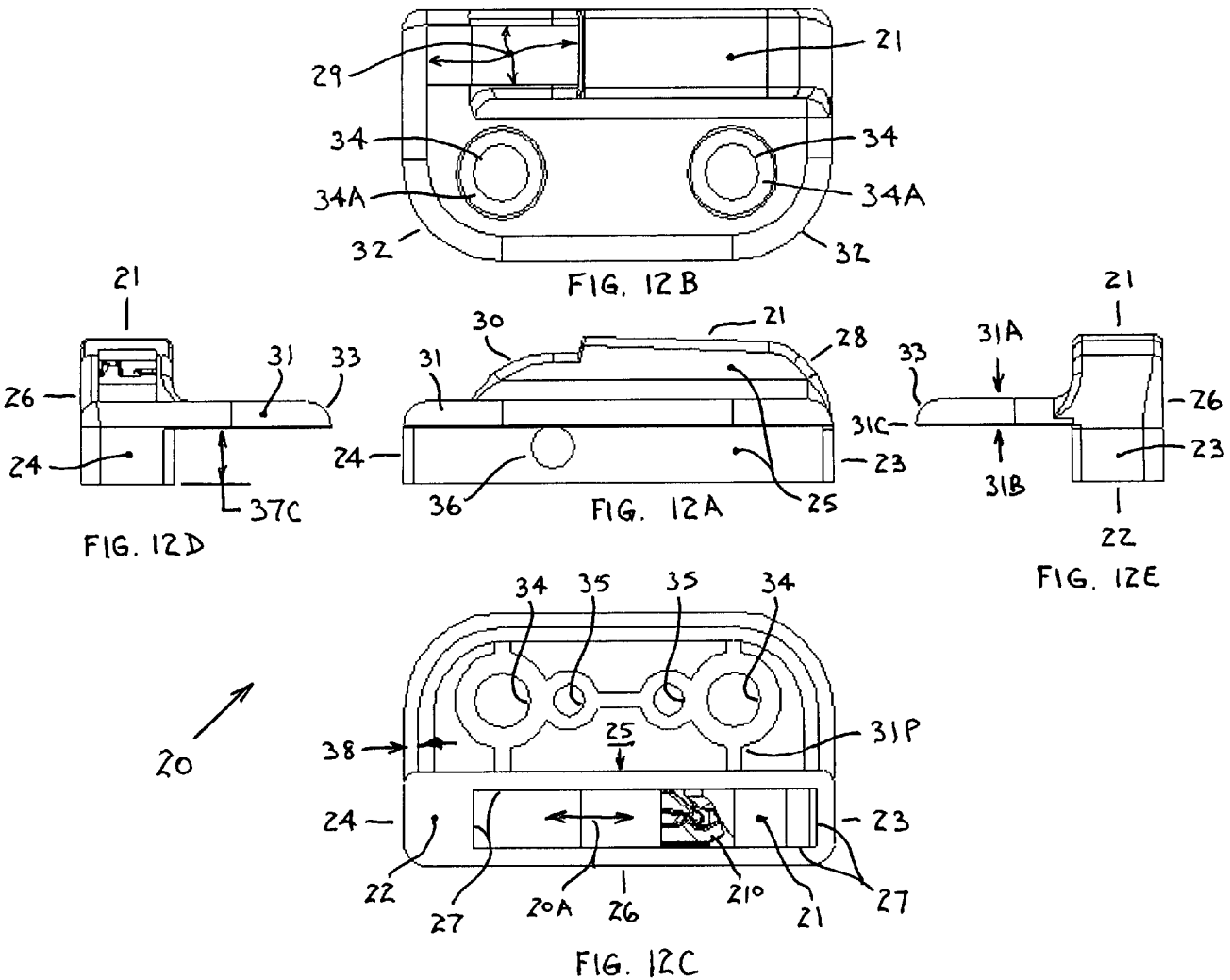
FIG. 12A is a front view of the window stop housing.
FIG. 12B is a top view of the window stop housing of FIG. 4A.
FIG. 12C is a bottom view of the window stop housing of FIG. 4A.
FIG. 12D is a left end view of the window stop housing of FIG. 4A.
FIG. 12E is a right end view of the window stop housing of FIG. 4A.
Figure 13:
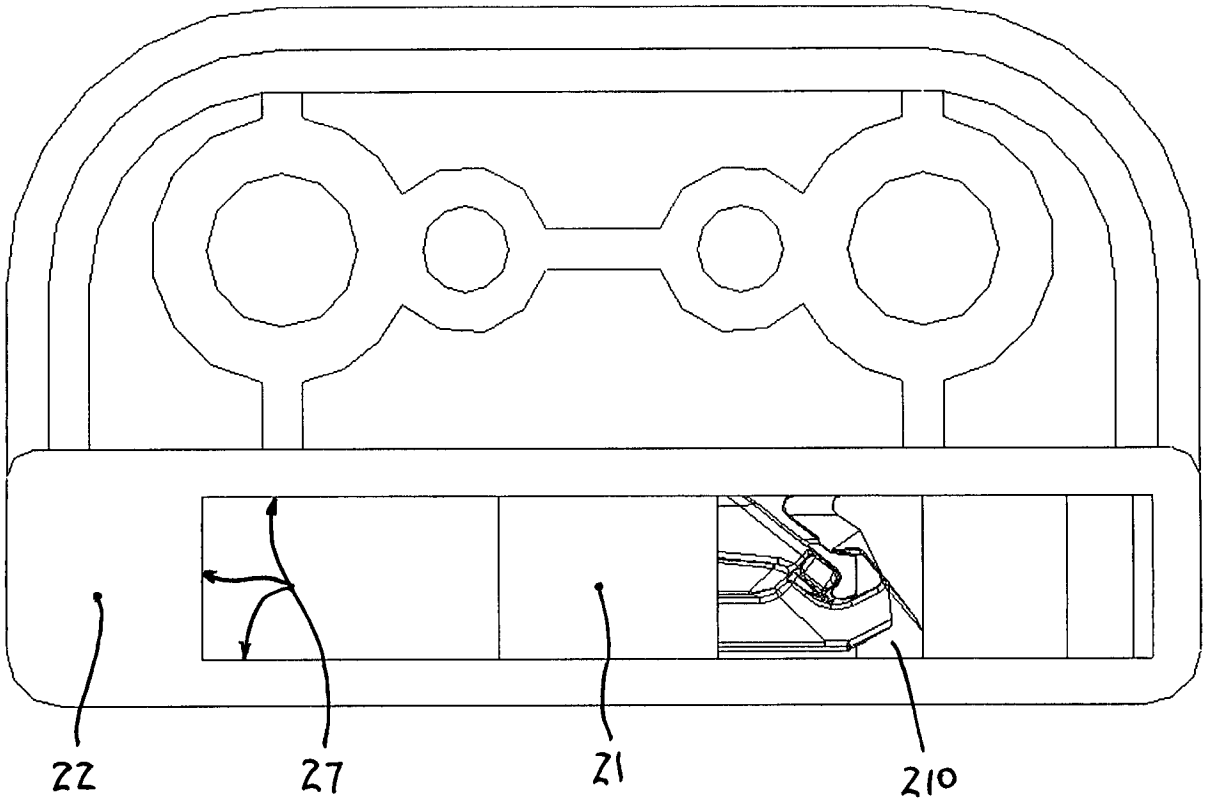
FIG. 13 is the bottom view of FIG. 12D, but enlarged to show the housing contour features that interact with the biasing member.

The thickness of the mounting flange 31, as well as the housing walls 21-26, may be sized to prevent impact loads, generated from a force exerted on the sliding sash by an intruder, from easily destroying the safety stop, as an intruder may seek to gain unauthorized entry into a dwelling in that manner. The choice of material for constructing the stop may similarly serve to deter such a forced entry. The periphery 31C of the mounting flange 31 may have the upper edge broken with a radius 33, as seen in FIGS. 12D and 12E.

The mounting flange 31 may be positioned on the second side wall 25 so as to be located in between the top wall 21 and the bottom wall 22 of the housing 20. The mounting flange 31 may be offset from the bearing surface area 45 of the tumbler a distance 37A (FIG. 6) that may accommodate most windows. The amount of offset relates to the invention providing the capability of a functional installation on variations different configurations of windows and doors, as will be discussed hereinafter. It should be noted that the offset could be incrementally varied so as to produce a series of different stop assemblies to accommodate the different sash-to-frame depth differences discussed later (see FIGS. 27-30), but the invention may preferably be practiced according to the embodiment described herein where the spacers permit a user to install the stop on various different windows without needing to purchase a specific stop having a particular offset.

Figure 6:
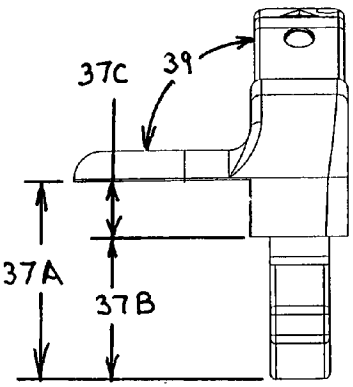
FIG. 6 is a side view of the adjustable window stop of the current invention.

The bottom wall 22 of the housing may also be generally flat and be offset from the bearing surface area 45 a distance 37B (FIG. 6), so that the flange 31 position on side wall 25 and the housing bottom wall 22 have a corresponding relationship. Therefore, the mounting flange may also be generally parallel to the bottom wall 22, but offset therefrom by an amount 37C (FIGS. 6 and 12E). The mounting flange 31 may also protrude out from the housing side wall 25 to be at and angle 39 relative to that wall. The angle 39 may preferable be 90 degrees, but the flange may also protrude out at a non-orthogonal angle.

The housing 20 may further comprise an opening 27 in at least a portion of the bottom wall 22 to expose cavity 20A, to thereby accommodate pivotal installation therein, and subsequent pivotal motion therefrom, of the tumbler 40. The opening 27 may remove the bottom wall 22 completely between the first side wall 25 and the second side wall 26, as seen in FIG. 12C. Opening 27 may also remove the bottom wall up to the inside of wall 23, but may fall short of reaching wall 24

Figure 4:
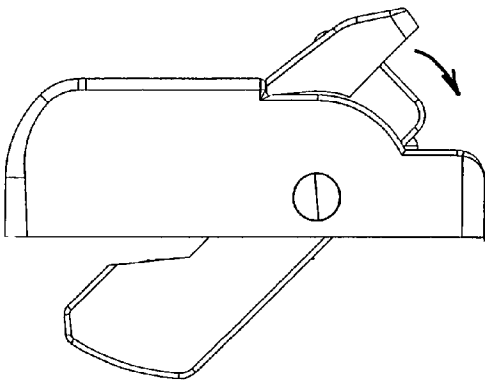
FIG. 4 is a side view of the adjustable window stop of the current invention.
Figure 3:
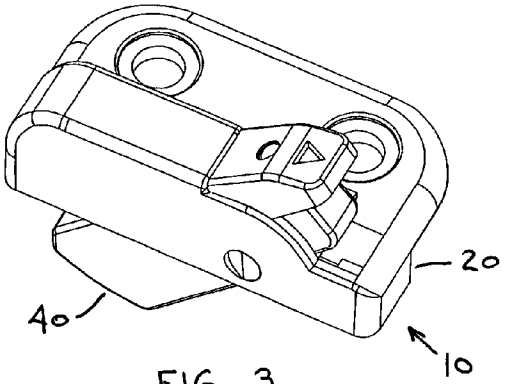
FIG. 3 is a perspective view of the adjustable window stop of the current invention.

There may also be an opening 29 in the top wall 21 to expose cavity 20A, as seen in FIG. 12B. The top wall 21 and the first side wall 25 and second side wall 26 may be trimmed back to have a periphery 30, which may enable insertion of the tumbler 40 through the opening 29, for its pivotal mounting in the housing cavity 20A (FIG. 4). The pivotal mounting may be accommodated by a pair of in-line holes 36 in the first and second side walls 25 and 26, to receive a pair of integral pins on the tumbler 40. In an alternate embodiment, there may be pins on the housing 20 to be received by an orifice in the tumbler 40 (not shown), or there may be a separate pin that is received by holes in both the housing walls and the tumbler. In addition, the housing 20 may also have a curved transition wall 28 between top wall 21 and first end wall 23 (FIG. 12A).

Figure 7:
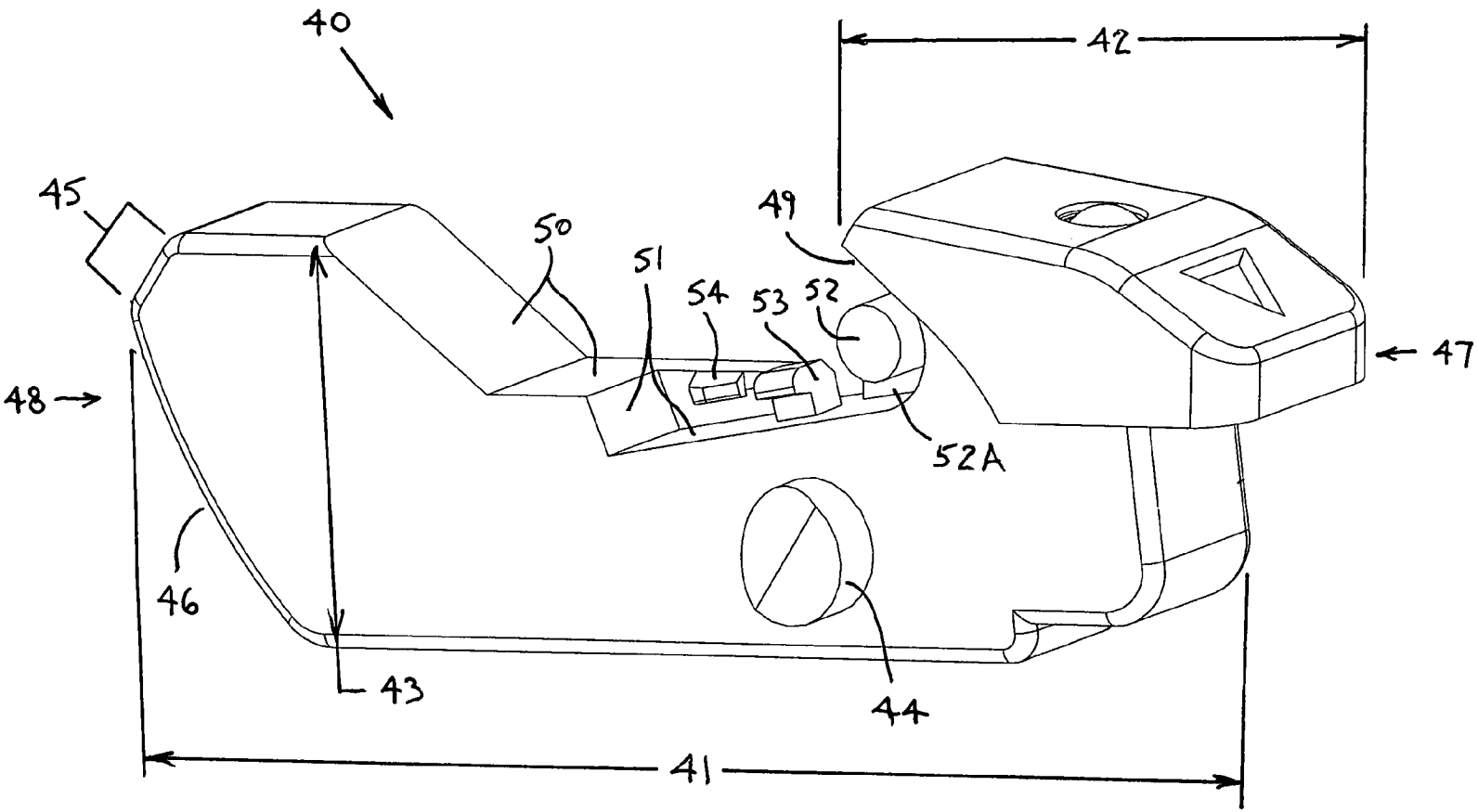
FIG. 7 is a perspective view of the tumbler of the safety stop of the current invention.

Tumbler 40, as seen in detail in FIG. 7, may be comprised of a body portion 41, and a button portion 42, and may be considered to have a first end 47, where the button may be located, and a second end 48. The body portion 41 may be comprised of an elongated, generally rectangular section 43 that is interrupted by several features. The elongated body portion 41 may be so shaped to fit within the cavity 20A of housing 20, that may be formed by the generally orthogonal housing walls 21-26. The body 41 may include a pair of cylindrical pins 44 protruding outward from each side of the body. The periphery of body 41 may also include a curved portion 46, which may be used to help deflect the tumbler, when it is not in the safe (first) position, as will be discussed hereinafter in the description of the installation of the safety stop assembly 10. The body 41 may also include a bearing surface area 45, which may be used when the safety stop assembly is in the safe position, to inhibit travel of the sliding sash by having the to rail 103A of the sash member 103 contact the bearing area 45.

The periphery of the body 41 may also be interrupted by a first notch 50, and also by a secondary notch 51, which may not cut completely across the entire width of the tumbler body from one side to the other. Both notches may nonetheless leave behind several protruding features. These protruding features include a cantilevered post 52, an L-shaped protrusion 53, and a straight protrusion 54, all of which may be used to secure the second end 65 of biasing member 60 to the tumbler 40.

Figure 23:
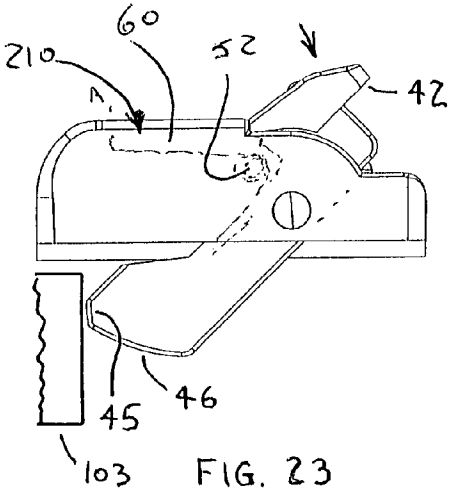
FIG. 23 is a side view of the adjustable after-market window stop of the current invention, shown with the tumbler in the first (fully extended, blocking) position.
Figure 24:
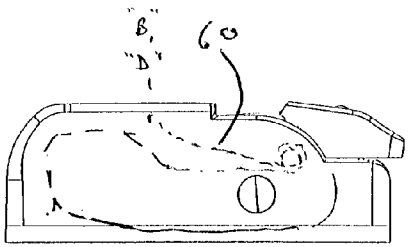
FIG. 24 is a side view of the adjustable after-market window stop of the current invention, shown with the tumbler in the retracted position.
Figure 25:
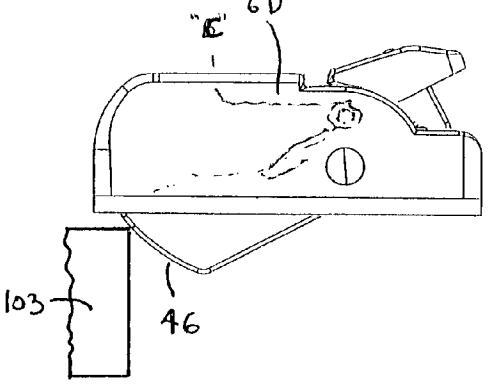
FIG. 25 is a side view of the adjustable after-market window stop of the current invention, shown with the tumbler in the second position, and with a sash contacting the curved tumbler surface ready to deflect the tumbler out of its path.
Figure 26:
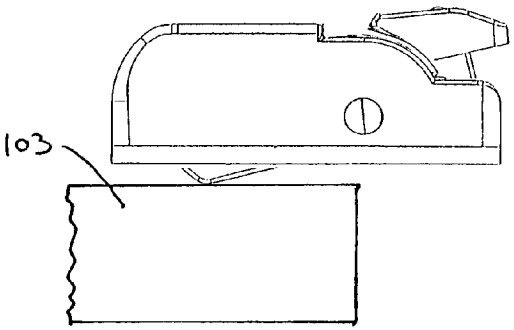
FIG. 26 is a side view of the adjustable after-market window stop of the current invention, shown with the tumbler in the intermediate position.
Figure 29:
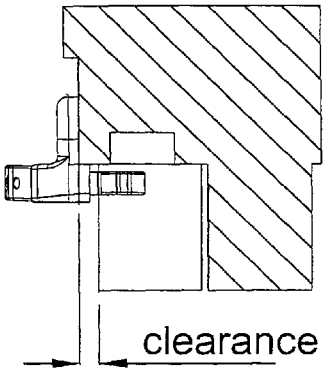
FIG. 29 is the section cut of FIG. 28, showing the same after-market stop but with only one spacer, for a window with a sash member having a larger offset from the master frame than the window of FIG. 28.
Figure 27:
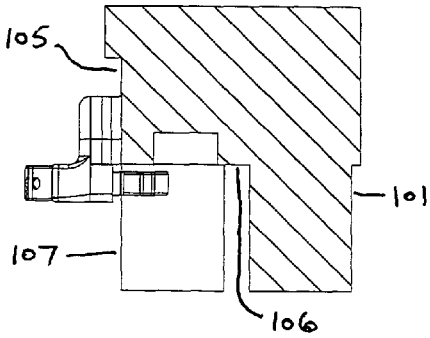
FIG. 27 is the section cut of FIG. 2, enlarged and showing need for an after-market stop with three spacer blocks for a window with a sash member co-planer with the master frame.

The integral button portion 42 may be of any shape and size that may conveniently receive pressure from a user's finger to toggle the tumbler from a safe (first) position to a non-safe (second) position, and for toggling the tumbler from the second position back to the first position. The tumbler positions achieved by the current invention are shown in succession in FIGS. 23-26. The safe (first) position is shown in FIG. 23. Thereafter, application of a generally downward force to the button portion 42, results in the tumbler being completely or nearly completely disposed within the cavity 20A of housing 20, in the retracted position as seen in FIG. 24. The tumbler will temporarily occupy the retracted position, until the force is removed from the button portion 42, after which the biasing member 60 will bias the tumbler to be in the non-safe (or second) position, as seen in FIG. 25. When in the non-safe position, the sliding sash member 103 of the door or window may strike the curved surface 46 of the tumbler, and thereby deflect it out of the way, with the tumbler then occupying an intermediate retracted position, as seen in FIG. 26. The intermediate retracted position could be any position between the full retracted position of FIG. 24 and the non-safe position of FIG. 25. However, in general, the intermediate retracted position may be a position in which the second end of the tumbler is only protruding out from the housing 20 a slight amount, which may be roughly equal to the clearance between the sliding member and the housing bottom wall 22 (see FIG. 26). In a preferred embodiment, the integral button portion 42 may have a curved surface 49 (FIG. 7) that mirrors the curved surface 30 of the housing 20 (see FIG. 12A), as the button portion may be proximate thereto throughout the various positions of the tumbler (FIGS. 23-26).

The biasing member 60 may comprise many different embodiments, and may alternatively be a compression spring, a tension spring, a leaf spring, or a torsion spring, etc. In a preferred embodiment, the biasing member 60 may comprise the torsion spring illustrated in the perspective view of FIG. 8. The biasing member 60 may be a helical torsion spring having a first arm 61 and a second arm 62, being connected by one or more helical turns 63 that may create a torsional restoring force, when the arms 61 and 62 are moved apart from a rest position into a deflected position. In general, the helical turns (or coil) may be subjected to twisting about the axis of the coil by sideways forces (bending moments) applied to its ends—the arms, twisting the coil tighter. The biasing member, when constructed as a helical torsion spring, may be formed of metal rod or wire.

The second arm 62 may transition to a pair of bends that terminate in a second end 65. With the turns 63 being mounted upon the post 52 of tumbler 40 (FIG. 20), the second arm 62 and second end 65 may be fixed within the protruding features of tumbler 40. The second arm 62 may be constrained between the flat side of the L-shaped protrusion 53 and both the straight protrusion 54 and lower portion 52A of the post 52. The lower portion 52A may extend upward from notch 51, and may be wherefrom the post 52 is cantilevered. The second leg 65 may be deflected outward to then be released so as to be trapped within the "L" portion of the L-shaped protrusion 53.

Figure 8:
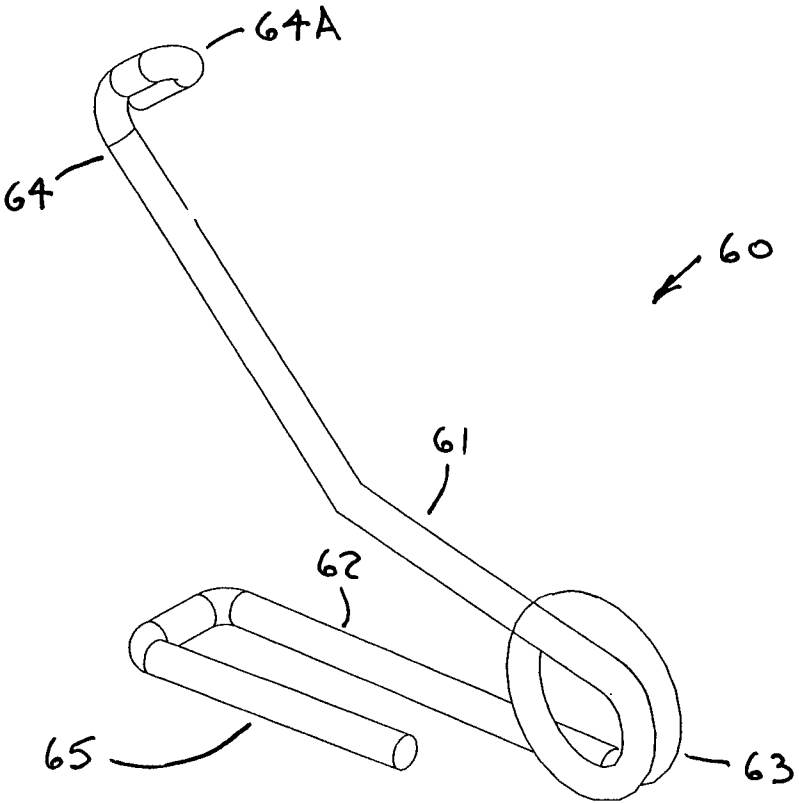
FIG. 8 is a perspective view of the biasing member of the safety stop of the current invention.

The first arm 61 may have a slight kink, as seen in FIG. 8, and then may transition into a first end 64, which may include a post 64A. The post 64A may be just the wire or rod of the torsion spring terminating to have a rounded (spherical) end, or it may alternatively have a 180 degree bend to produce a rounded edge, either of which will be referred to hereinafter as "the post." The post 64A may serve to interact with contoured features 210 on the underside of wall 21 of housing 20 (FIGS. 13-19), to maintain the tumbler in the non-safe position, once the tumbler has been installed into the cavity 20A.

Assemblage of the housing 20, tumbler 40, and biasing member 60 into the adjustable window stop assembly 10, may be seen through the exploded view of FIG. 20. The biasing member 60 may be installed onto the tumbler 40 features as previously described. By next depressing the first arm 61 relative to the tumbler, to counter the torsion force created by the coils 63, the second end 48 of the tumbler 40 may be inserted into the cavity 20A through the opening 29 of housing 20. The pins 44 on opposite sides of the tumbler body may received by the orifices 36 of the first and second side walls 25 and 26 of housing 20, to establish pivotal mounting of the tumbler within the housing, and also leaving a portion of the tumbler second end 48 to protrude out through opening 27 of bottom wall 22 of housing 20. Once the tumbler is pivotally mounted within the housing 20, the force used to depress the first arm 61 of the biasing member 60 relative to the tumbler 40 may then be released, and the post 64A of the biasing member 60 will contact the contoured features 210 of the housing 20. That contact is seen in FIGS. 14-19.

Figure 14:
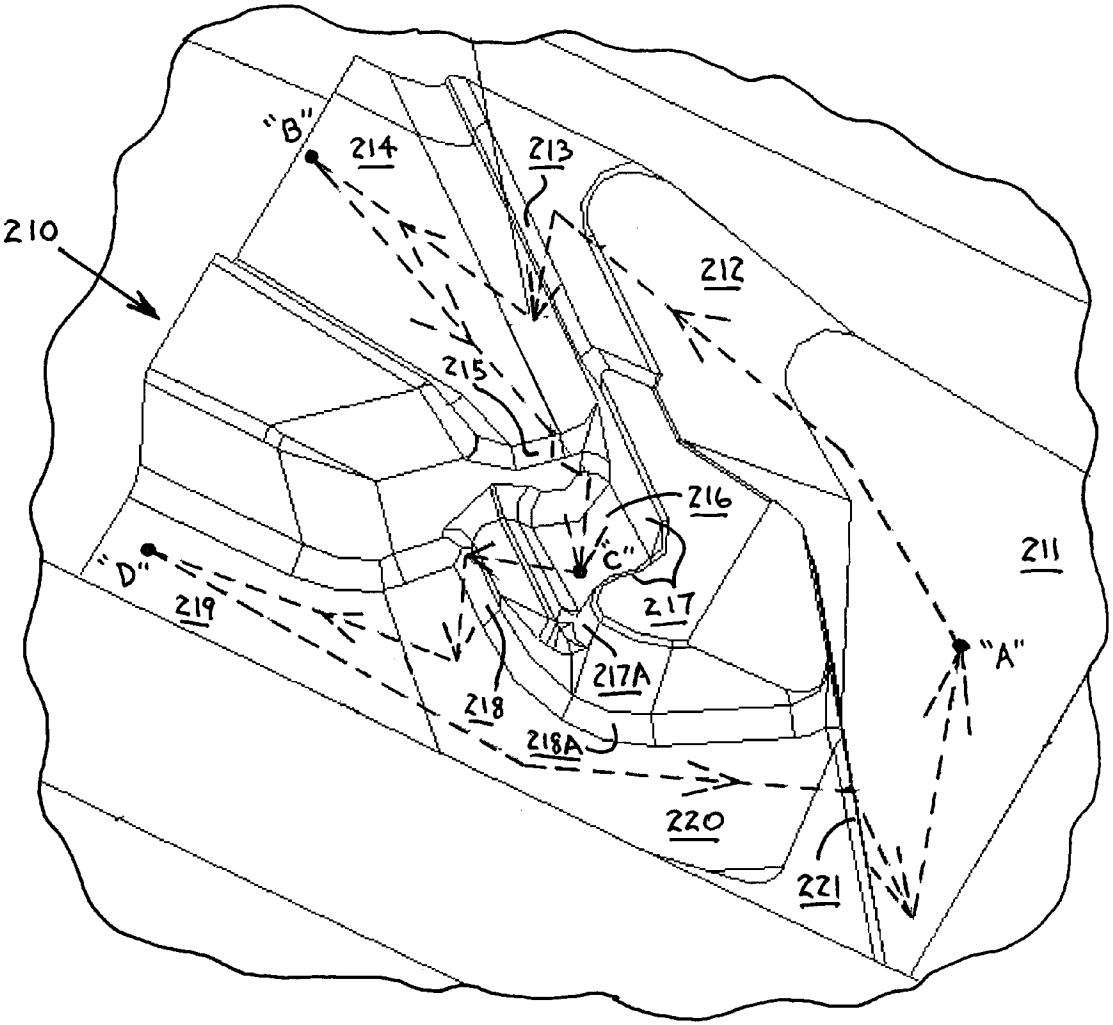
FIG. 14 an enlarged perspective view of the housing contour features of FIG. 13, with the two positions of the biasing member illustrated thereon—Safe (A) and Non-safe (B), as well as motion in between, including two temporary positions (B & D) in which the tumbler is retracted.
Figure 15:
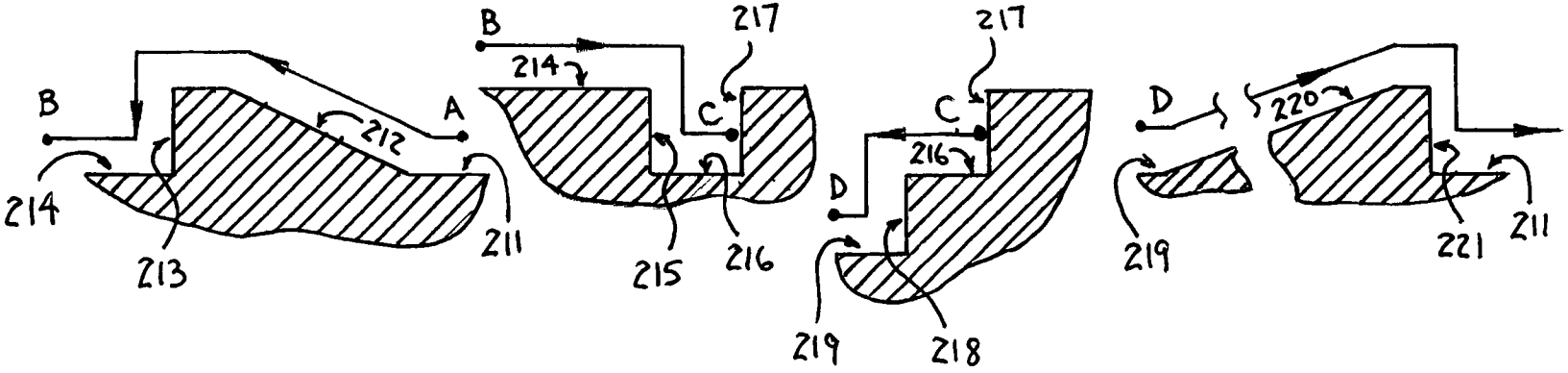
FIG. 15 is a series of schematic representations showing the positional changes (A, B, C, and D) of the post of the biasing member, relative to the housing contour of the underside of the top housing wall.
Figure 16:
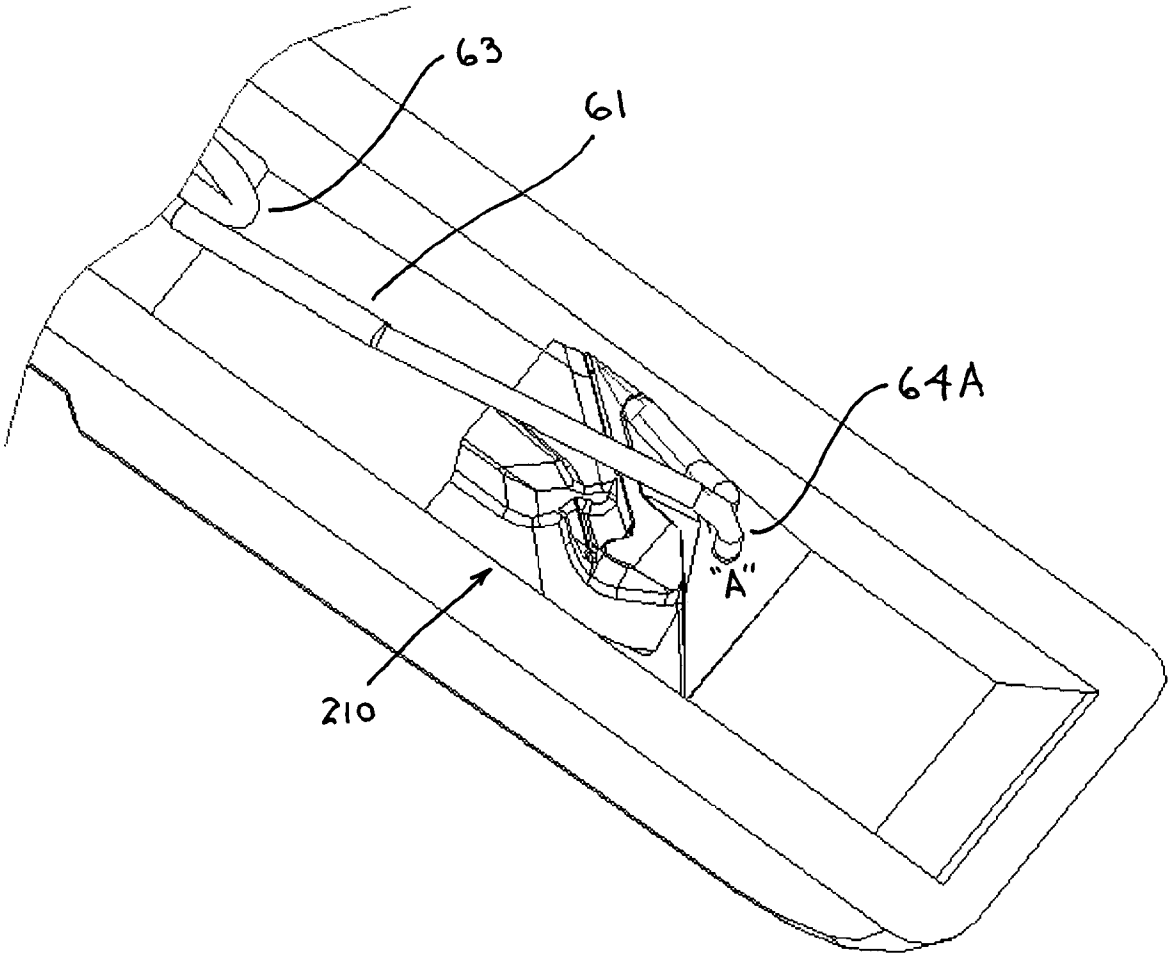
FIG. 16 is the view of FIG. 13, but enlarged to show the housing contour features, and with the post of the biasing member shown in a position ("A") relative to the contour that the post occupies when the tumbler is in the safe position.
Figure 17:
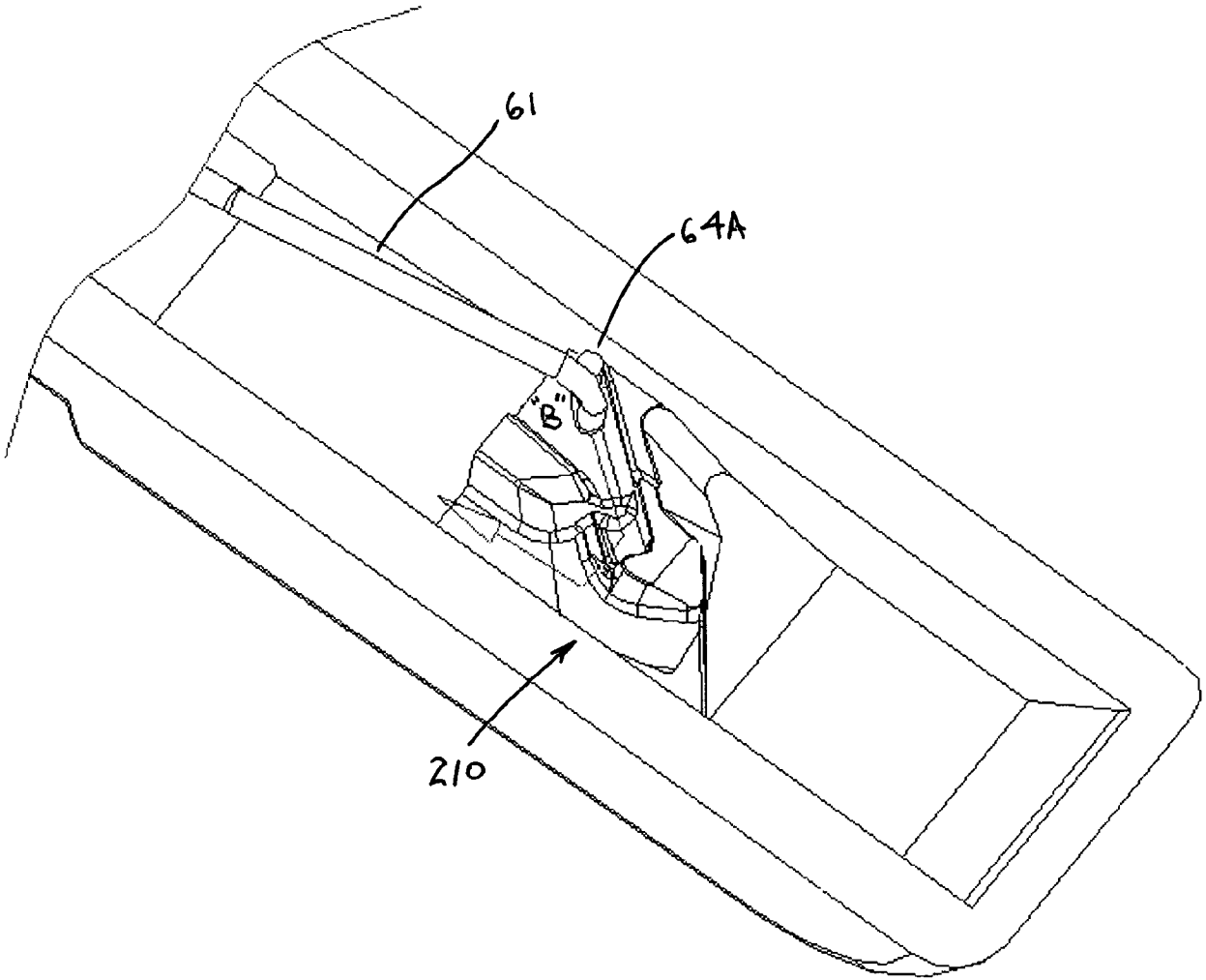
FIG. 17 is the view of FIG. 16, but with the post of the biasing member shown in a position ("B") relative to the contour that the post occupies when the tumbler is in the retracted position, as the tumbler is being toggled from the safe to the unsafe position.
Figure 18:
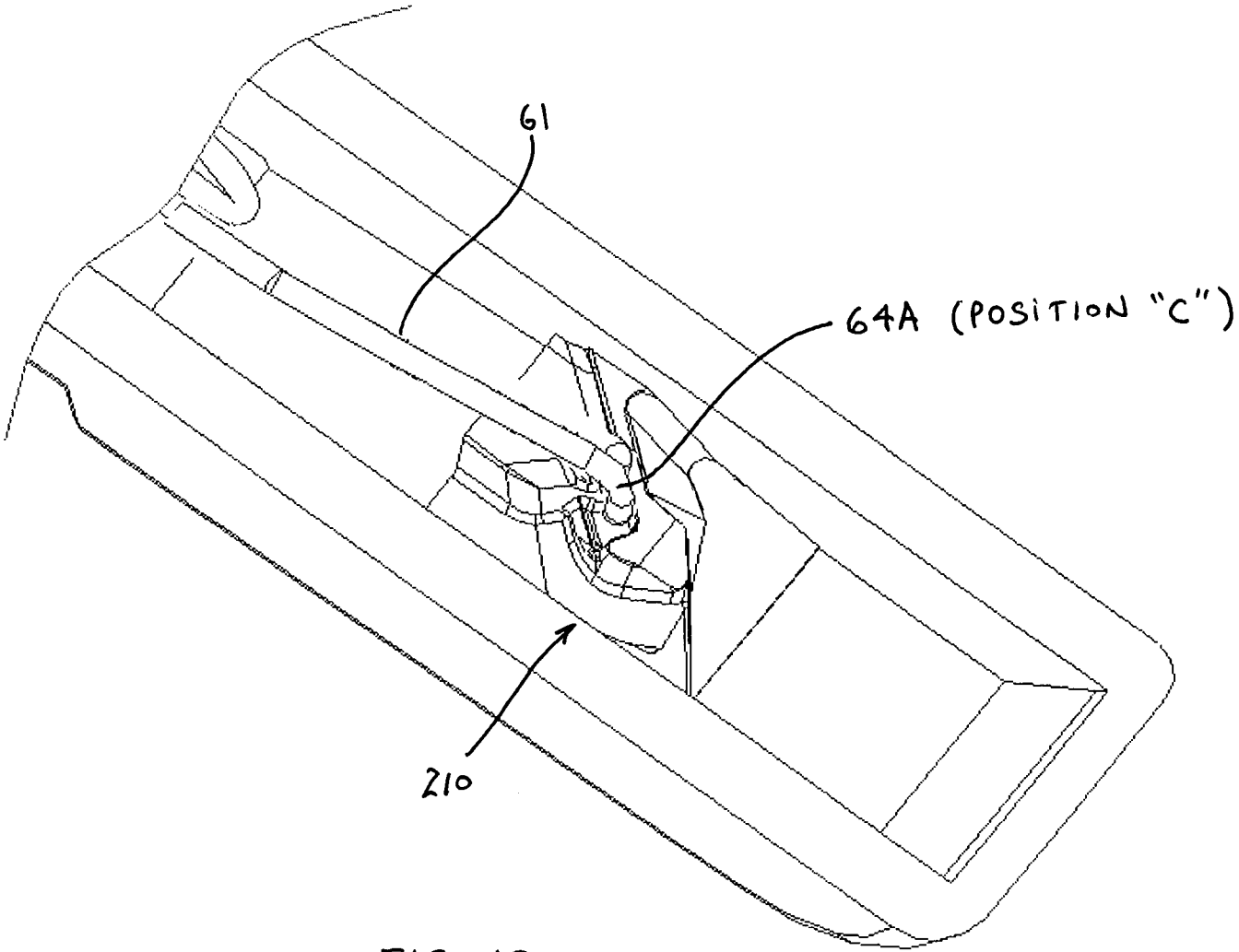
FIG. 18 is an enlarged view of FIG. 17, but with the post of the biasing member shown in a position ("C") relative to the contour that the post occupies when the tumbler is in the un-safe position.
Figure 19:
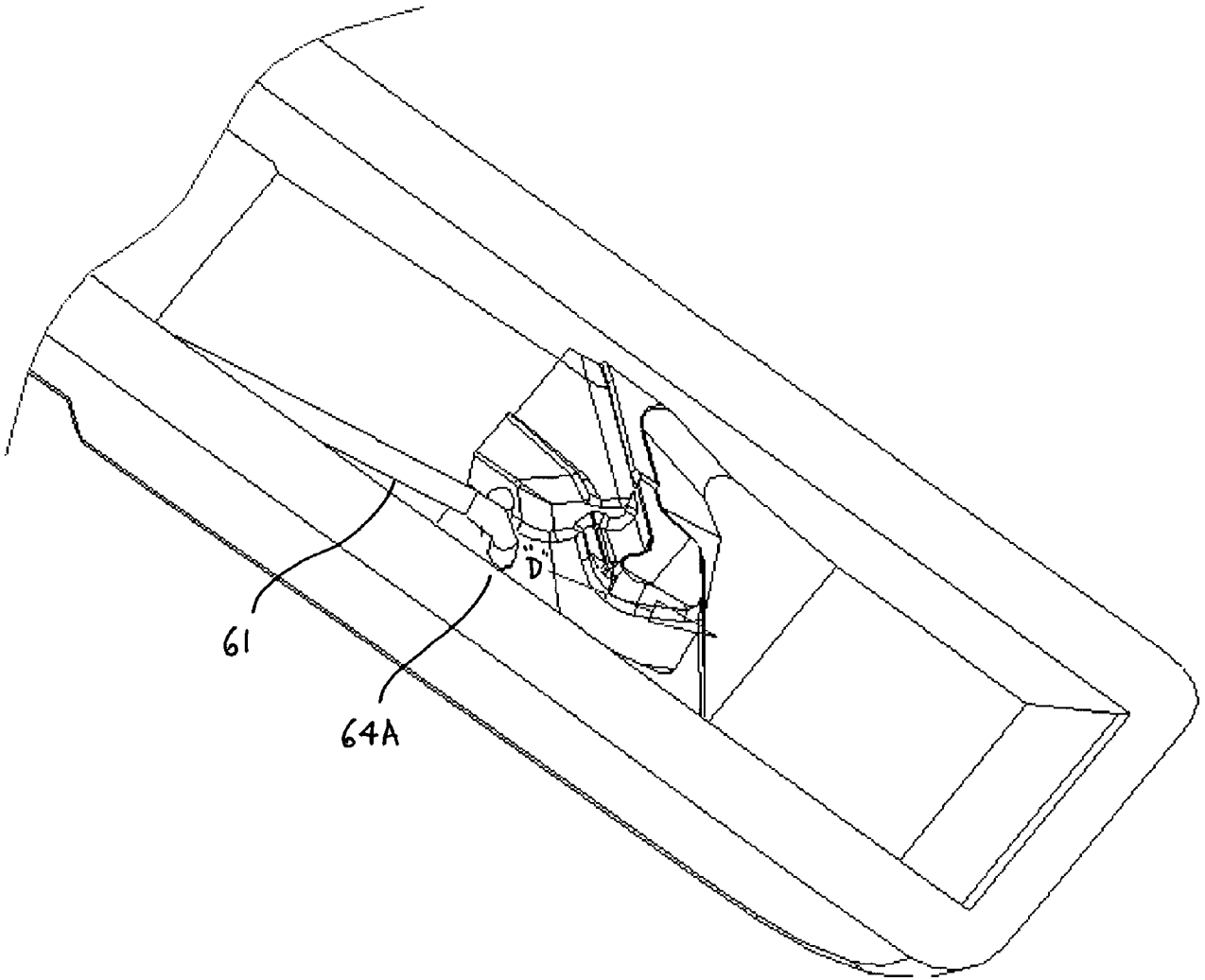
FIG. 19 is the view of FIG. 18, but with the post of the biasing member shown in a position ("D") relative to the contour that the post occupies when the tumbler h is in the retracted position, as the tumbler is being toggled from the unsafe to the safe position.

FIG. 14 illustrates, in detail, the contour features 210 of the underside of the wall 21 of housing 20, and shows thereon the positions that the post 64A of the biasing member 60 may occupy. The movement of the post 64A is shown upon the contour features 210 in FIG. 14, and also is shown schematically in FIG. 15 to aid the reader in understanding the operation of the tumbler. When the tumbler is in the safe position (FIG. 23), the post 64A of the tumbler occupies the position "A" of FIG. 14, and rests upon surface 211. As a user depresses the button 42 of the tumbler to move the tumbler from the safe position to the retracted position (FIG. 23 to FIG. 24), the post 64A in FIG. 14 will move from position "A" to position "B." In doing so, the post 64A may move from surface 211 to contact an inclined surface 212, and then drop along a vertical face 213, to then continue along a generally flat surface 214 until reaching position "B." Once the user releases the force from button 42 of the tumbler, the tumbler is biasing by biasing member 60 into the non-safe position (FIG. 25). Movement of the post 64A, after the user releases that force, is from position "B" to position "C." In moving from position "B" to position "C," the post 64A may move from the generally flat surface 214, to drop along a vertical face 215 and traverse along surface 216, where the post 64A may be nested against a curved vertical face 217. It should be pointed out that the use herein of the adjective "vertical" is to be loosely interpreted as it is being used to aid the reader in understanding the described contoured features 210 of the housing 20. Those faces, in fact, need not be "vertical" relative to the housing wall 21 or orthogonal thereto, and need only to protrude outward from either the flat or inclined surfaces to guide the travel of the post 64A. However, for simplicity in further describing the invention, the term vertical will still be used herein.

Biasing by the biasing member 60 will seek to deflect the tumbler 40 from the non-safe to the safe position, but is prevented from doing so by the vertical face 217 serving to restrain the movement of post 64A of the biasing member, which inhibits outward rotation of the tumbler. This rotationally restrictive relationship may be understood by looking at the positions of post 64A (A, B & D, and C) relative to the profile views of housing wall 21 in the FIGS. 23-25. Also, the post 64A is shown occupying positions A, B, C, and D, sequentially, in FIGS. 16-19.

Movement of the tumbler from the non-safe to the safe position may occur by the user again applying a force to button 42, which causes the tumbler to again move into a retracted position and with the post 64A respectively moving from position "C" to occupy position "D." In moving from position "C" to position "D," the post may move along surface 216, drop along a vertical face 218, then traverse from an inclined surface 220 to a generally flat surface 219. Once the user releases that force from button 42 of the tumbler 40, the tumbler is biased by biasing member 60 into the safe position (FIG. 23). Movement of the post 64A, after the user releases that force, is from position "D" to position "A." In moving from position "D" to position "A," the post may move along generally flat surface 219, then up the inclined surface 220 and down a vertical face 221, and then traverse along surface 211 until reaching position "A." It should be pointed out that the direction of movement of the post 64A is aided by those vertical faces, which serve to prevent erroneous movement. For example, for movement of the post 64A from position "D" to position "A," the post is prevented from inadvertently returning to "C" by the vertical face 218, which curves around at curved vertical face 218A, and thereby forces the post 64A to traverse along surface 220 and towards position "A." Movement between each of the other positions—A to B, B to C, and C to D—is similarly accomplished by vertical faces 221, 213, and 215. The incline surfaces serve in combination with the vertical faces to facilitate construction of a continuous series of contours to permit the described motion of the post 64A.

It may now be seen by looking at FIGS. 14 and 25, that the movement from position C towards position D may be arranged so that the vertical face 217 has a rounded vertical end 217A and that vertical 218 is very quickly encountered after the post 64A has moved from position "C." This would provide an arrangement where, in looking at FIG. 25, it may be seen that slight deflection by the sash 103 of the tumbler 40 will cause the post 64A to slip around the rounded vertical end 217A and down the vertical face 218, in proximity to curved vertical face 218A, to then be biased to position "A" without occupying position D. This may be advantageous in an embodiment where the safety stop will tend to always be in the safe position, because even where the user has toggled the tumbler to the un-safe position to open the window all the way, once the window strikes the tumbler, it will be released from position "C" as just described, and when the sash window has been return to the closed (or near closed) position, the safety stop will then automatically bias the tumbler to the safe position—with the stop being in position "A." If vertical face 117 and vertical face 218 extend further in the direction towards position "D," the ability to have the window automatically trip the tumbler to bias back to the safe position may be prevented, and would thus require the user to manually choose to do so. This arrangement may also be a desirable feature for an alternative safety stop.

Similarly, it may be seen that complete movement of the post 64A into position "B," wherein the tumbler is fully retracted within the housing, is not necessary, as the post need only move beyond the vertical face 213 to ensure that it will maneuver into position "C," once the force is removed from button 42. However, vertical face 213 may be moved so as to be proximate to position "B," which would necessitate that a fully retracted or near-fully retracted tumbler position would be reached before ensuring that the post would be force to engage with vertical face 217 at position "C."

Figure 11:
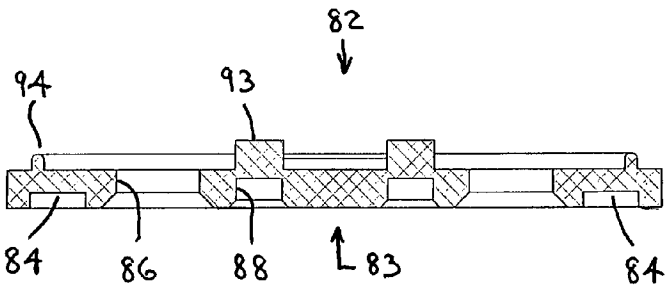
FIG. 11 is a section cut through the spacer block of FIG. 19.
Figure 9:
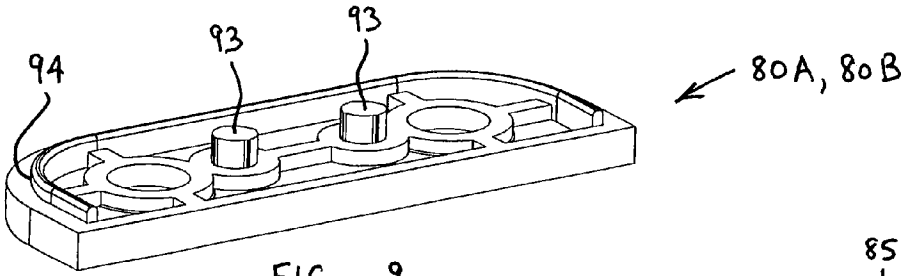
FIG. 9 is a top perspective view of one embodiment of a spacer block.
Figure 10:
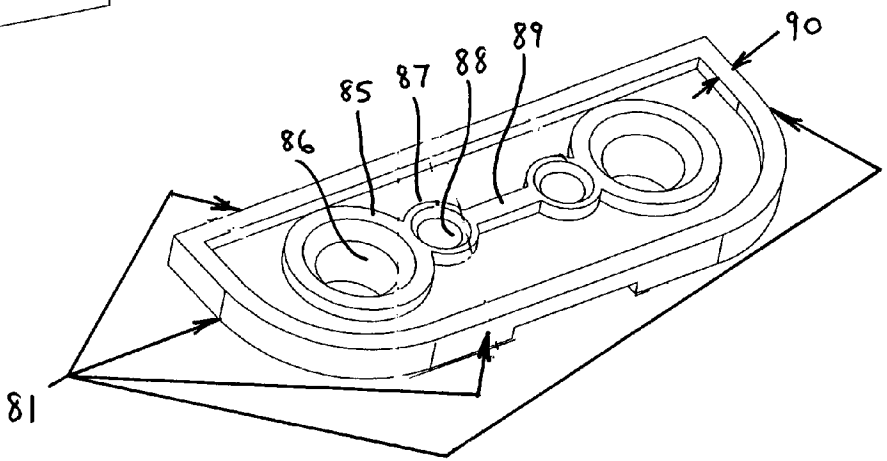
FIG. 10 is a bottom perspective view of the spacer block of FIG. 19.

One embodiment of the spacer blocks, 80A, 80B, etc, is shown in FIGS. 9-11. The spacer blocks 80A and 80B may be identical, except for possible differences in thickness of the spacers. For the sake of commonality, only one thickness of spacer might be used, and being a very small thickness, wherein multiple spacers could be used as needed, however, the varying thickness spacers may be more practical. The spacers will be discussed generically in terms of spacer 80A, but the discussion may apply to other spacers, 80B, 80C, etc, as well, except for the aforementioned thickness differences.

The spacer 80A may have a periphery 81 that matches the periphery of the mounting flange 31 of housing 20. Spacer 80A may also have a top 82 and a bottom 83. The bottom 83, as seen in FIGS. 10 and 11, may have a sculpted cavity 84, leaving behind a ridge of thickness 90, and a boss 85 surrounding a pair of orifices 86 that match the mounting orifices in the mounting flange 31 of the housing 20 (for receiving safety stop mounting fasteners), and a boss 87 around a second pair of smaller orifices 88. The smaller orifices 88 in the spacer, like the orifices 35 in the mounting flange 31 of housing 20, may be full depth, or may be depth limited as seen in FIG. 11. The boss 87 about each orifice 88 may be connected by a stiffener 89.

The smaller orifices 88 of the bottom 83 may be for receiving the posts 93 protruding up from the top surface, which would occur where multiple spacers (80A and 80B . . . ) are used. The posts 93 would be received, for the first spacer utilized with the stop assembly 10, by the orifices 35 in the bottom surface 31B of mounting flange 31. They may simply be nested therein, or they may be received therein using a friction fit or using a detent where the spacer would have to snap into place on the mounting flange (or other spacers when more than one spacer is used). The top surface 82 may also have an upward protruding lip 94 that spans at least part of the periphery 81, and which may be received by the ridge of thickness 38 in the bottom surface 31B of the mounting flange 31 of the housing 20, or alternately received by the ridge of thickness 90 in the bottom of other spacers, if used.

The adjustable safety stop assembly 10 may be installed on a window while the window is being assembled by a window manufacturer, or alternatively, may be installed after the window has been assembly but prior to its installation in a building. Additionally, it is also possible to install the safety stop 10 on a sash window or door that is already in service in a building, where the assembly would be supplied as an after-market stop, for use on sash members of a window/door product that did not originally incorporate a safety lock into the design of the window or door. Furthermore, after-market safety stop herein may also be installed on a window or door already in service in a building, where the window/door already had a safety stop integrally assembled into the window/door, but where the person using the window prefers to have the window stop at alternative or additional sash travel-limited safety locations. Generally, such pre-installed stops provide generous travel for the sash, but not being travel that is great enough to allow entry through the window by a burglar or other intruder. A home owner may prefer to add safety stops to that window to limit the travel to only about one or two inches, possibly to prevent a small pet from escaping, and might feel that the window only being opened that small amount would provide sufficient ventilation into the room. Also, the home owner may wish to add another safety stop to permit the window to open a little further for increased ventilation, but still not be opened enough to allow a small child to accidentally egress out of the open window. There may be many reasons for adding one or more additional safety stops to a newer window that already has an integral stop.

Figure 22:
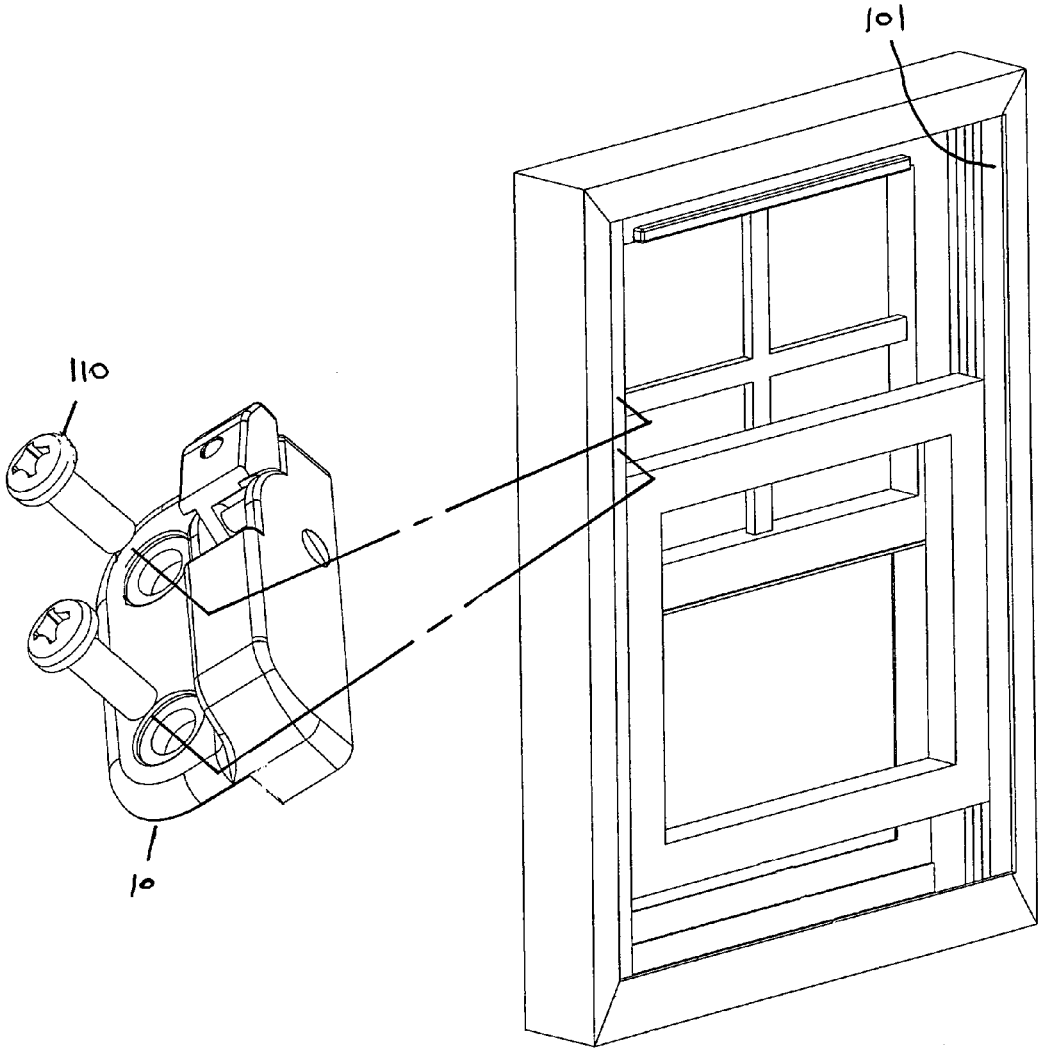
FIG. 22 is a perspective view of the safety stop assembly of the current invention and two screws, prior to installation, and being shown in relation to a perspective view of a sliding sash window and master frame to which the stop is to be secured.

FIG. 22 shows a pair of screws 110 that may be used to mount the after market safety stop 10 to the master frame 101 of single hung or double hung sash window or door. FIGS. 34-37 illustrate the use of multiple spacers or no spacers, in cross-sectional views of different window configurations which have various differences in height between the sash 103 and master frame 101.

As seen throughout these views, installation of the safety stop assembly 10 may be with the bottom surface 31B of the mounting flange 31 contacting the inward facing side 105 of the master frame 101, with the tumbler second end 48 being adjacent to a side surface 106 of the master frame 101 (FIG. 27), and with the tumbler bearing surface at the second end being proximate to the top rail of the lower sliding sash member (FIG. 23). The top rail of the lower member may best be referred to herein for safety locking, as an inner rail 103A of the sliding sash member.

Figure 30:
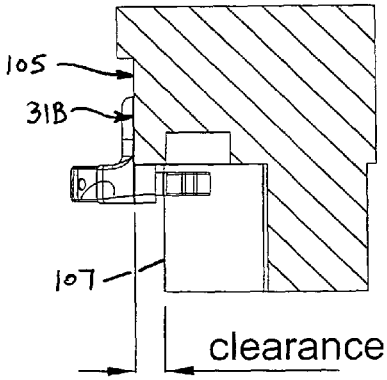
FIG. 30 is the section cut of FIG. 29, showing the same after-market stop but with no spacers, for a window with a sash member having a larger offset from the master frame than the window of FIG. 29.
Figure 28:
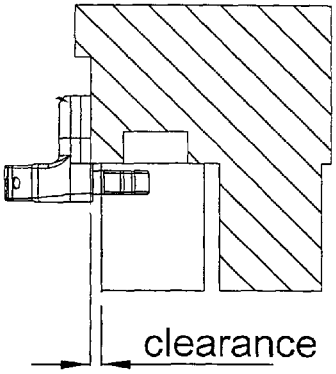
FIG. 28 is the section cut of FIG. 27, showing the same after-market stop with two spacers for a window with a sash member being slightly offset from the master frame.

The offset amount in locating the mounting flange 31 on the side wall 25 of housing 20 relative to the bottom wall 22 may determine the thickness of the spacers used, along with the depth difference between the inward facing surface 105 of the master frame and the inward facing surface 107 of the sash 103, for a given safety stop assembly 10. As may be seen from FIGS. 27-30, a formula for the thickness of the total stack of spacer blocks may be approximately equal to that mounting flange offset minus the measured depth (or height) difference between the window and master frame, plus a small amount for clearance. As seen in FIG. 30, where the depth difference between the inward facing side of the master frame 105 and inward facing side 107 of the sash member 103 is equal to or slightly greater than the offset amount of the mounting flange, no spacer is required. As the depth difference is reduced in going from FIG. 27 through FIG. 30, the total thickness of the spacers 80A, 80B, . . . , that are used must increase. The maximum thickness would be required (FIG. 27) when the inward facing side of the master frame 105 and inward facing side 107 of the sash member 103 are flush (zero depth difference), and which would require a spacer total thickness approximately equal to the offset of the mounting flange from the bottom wall 22 of housing 20, plus a small added amount to provide clearance between the bottom wall 22 with the sash member 103, to thereby prevent its obstruction.

The examples and descriptions provided merely illustrate a preferred embodiment of the present invention. Those skilled in the art and having the benefit of the present disclosure will appreciate that further embodiments may be implemented with various changes within the scope of the present invention. Other modifications, substitutions, omissions and changes may be made in the design, size, materials used or proportions, operating conditions, assembly sequence, or arrangement or positioning of elements and members of the preferred embodiment without departing from the spirit of this invention.

We claim:

1. A stop, for use in attachment to a frame that supports a sliding sash member to thereat be configured to limit travel of the sash member between a closed position and a partially opened position, the partially opened position being a sash member position between the closed sash position and a full-open sash position, said stop comprising;

a housing, said housing comprising a cavity, a first opening in a top end of said housing configured to interconnect with said cavity, and a second opening in a bottom end of said housing configured to interconnect with said cavity;

a mounting flange, said mounting flange configured to protrude from said housing, said mounting flange comprising one or more openings configured to mount said stop;

a tumbler, said tumbler comprising a first end and a second end; said tumbler being pivotally mounted in said housing cavity, said tumbler second end comprising a bearing surface, said bearing surface transitioning into a curved surface;

a biasing member, said biasing member configured to be mounted to said tumbler to bias said second end of said tumbler to pivot outward from said housing, said biased pivotal travel of said tumbler configured to normally be limited to at least a first position or a second position, said tumbler being freely biased and limited to said first position when a push-button portion of said tumbler proximate to its first end contacts a portion of said housing; and said tumbler being biased but releasably limited to said second position by a portion of said biasing member being configured to selectively contact one or more contoured features on said housing and to engage a portion of said one or more contoured features during said biased pivotal movement of said tumbler, said second position comprising a position where a portion of said curved surface of said tumbler protrudes out from said housing; and said second end of said tumbler configured to be manually actuated to actuate said tumbler out from said second position, to thereby permit said biasing into said first position, after said actuation ends; and wherein when said tumbler is in said first position, said bearing surface of said tumbler is positioned to limit movement of the sash member between the closed position and the partially opened position; and wherein when said tumbler is in said second position, said tumbler is positioned to permit further movement of the sash member to the full-open position, by contact of the sash member with said curved surface to thereby cause pivotal movement of said tumbler into a partially retracted position, and to result in disengagement of said portion of said biasing member from said portion of said one or more contoured features of said housing, to thereafter permit said tumbler to be automatically biased back into said first position when the sash member is moved back to the partially opened position or back to the closed position or back to any position between the partially open position and the closed position, said partially retracted position comprising a position wherein a portion of said tumbler second end is positioned within said housing cavity.

2. The stop of claim 1, wherein said tumbler is configured to pivot at a point between said first end and said second end of said tumbler; and wherein said tumbler first end is configured to protrude from said first opening in said housing to thereby be actuated to cause said tumbler to toggle between said first position and a fully retracted position, said fully retracted position being a position where said tumbler is positioned completely within said housing cavity.

3. The stop of claim 2, wherein said tumbler is configured to be toggled from said first position to said second position by said tumbler initially being actuated to pivot from said first position to said fully retracted position; and wherein when said tumbler first end is subsequently no longer being actuated, said portion of said biasing member in said selective contact with said one or more contoured features of said housing being configured to move into said engaged position with said portion of said contoured feature to limit said outward pivotal travel of said tumbler to said second position.

4. The stop of claim 3, wherein said tumbler is configured to be toggled from said second position to said first position by said tumbler initially being actuated to pivot from said second position to said partially retracted position, with said portion of said biasing member and said one or more contoured features of said housing being configured to thereby permit movement of said portion of said biasing member out of said engaged position to no longer limit said outward pivotal travel of said tumbler to said second position; and wherein when said tumbler first end is subsequently no longer being actuated, said tumbler is biased back to said first position.

5. The stop of claim 4, wherein said biasing member is configured to be mounted to have an end of a first arm of said biasing member extend therefrom, to be secured to said tumbler, and to have a second arm of said biasing member also extend therefrom, with an end of said second arm configured to engage said portion of said one or more contoured features on said housing in said selective contact during said pivotal movement of said tumbler.

6. The stop of claim 5, wherein said mounting flange comprises a top surface and a bottom surface, and wherein said bottom surface is configured to be offset from said bearing surface.

7. The stop of claim 6, wherein said biasing member comprises a helical torsion spring, said helical torsion spring comprising a helical coil with said first and second arms extending therefrom.

8. The stop of claim 7, wherein said helical coil and said first arm of said torsion spring are secured to said tumbler, and wherein said portion of said biasing member configured to selectively engage said one or more contoured features on said housing comprises a post at said end of said second arm.

9. The stop of claim 8, wherein said selective engagement of said post of said biasing member with said portion of said one or more contoured features of said housing comprises guided post movement from a position "A" to a position "C"; said position "A" being a position at which said outward pivotal tumbler movement is limited to said first position of said tumbler by said portion of said first end of said tumbler contacting said portion of said housing; and said position "C" being a position at which said outward pivotal tumbler movement is limited to said second position by said post being engaged within a curved vertical face of said one or more contoured features of said housing.

10. The stop of claim 9, wherein said guided movement of said biasing member post from position "A" to position "C" comprises movement of said post up an inclined surface and over a first vertical face to a position "B", said position "B" being a post position beyond said first vertical face and corresponding to said partially retracted position of said tumbler resulting from said initial actuation of said tumbler; and wherein when said tumbler first end is subsequently no longer being actuated, said biasing of said tumbler causes said post to move back towards position "A" and contact said first vertical face, said first vertical face guiding movement of said post away from position "A" and down a second vertical face to be in position "C," said first vertical face transitioning into said curved vertical face.

11. The stop of claim 10, wherein said selective contact of said post with said one or more contoured features of said housing comprises further guided movement, said further guided movement comprising movement from said position "C" back to said position "A"; said further guided movement from position "C" to position "A" comprising movement of said post over a third vertical face and down a second inclined surface into a position "D," said position "D" being a post position corresponding to said partially retracted position of said tumbler after said initial tumbler actuation at said second position; and wherein when said tumbler first end is subsequently no longer being actuated, biasing of said tumbler causes said post to move up said second inclined surface and down a fourth vertical face to be in said position "A," said third vertical surface guiding movement of said post away from said position "C" and toward said position "A."

12. The stop of claim 3, wherein said one or more openings in said mounting flange comprises a pair of holes in said mounting flange, wherein each of said pair of holes is configured to receive a fastening means for mounting said stop.

13. The stop of claim 12, wherein said stop further comprises a spacer block, said spacer block being configured to be removably attached to said mounting flange, and having a thickness configured to adjust for variations in a height difference between the sliding sash member and the supporting frame.

14. The stop of claim 13, wherein said spacer block has a top surface, a portion of said top surface being configured to be removably attached to said bottom surface of said mounting flange by said spacer block top surface comprising one or more posts, and said mounting flange bottom surface comprising one or more respective orifices.

15. The stop of claim 14, wherein said one or more posts are configured to be removably received in said respective orifices by a sliding friction fit; and wherein said one or more respective orifices is in said mounting flange begin at said mounting flange bottom surface and runs at least part way between said bottom surface of said mounting flange and said top surface of said mounting flange.

16. The stop of claim 15, wherein said spacer block further comprises one or more orifices on a bottom surface for releasably receiving one or more corresponding posts of a second spacer block, said second spacer block being of a thickness different than a thickness of said first spacer block, said second spacer block further comprising one or more orifices on a bottom surface of said second spacer block.

17. The stop of claim 16, comprising a second spacer block configured the same as said first spacer block but having a different thickness.

18. The stop of claim 17, wherein each of said first and second spacer blocks comprises a periphery with a shape that matches a peripheral shape of said mounting flange of said stop.

19. The stop of claim 18, wherein said mounting flange protrudes out from said housing at a position between said top end and said bottom end of said housing; and wherein said mounting flange is generally parallel to said housing bottom end but is displaced therefrom by an offset amount.

20. The stop of claim 19, wherein a combined thickness of said first and second spacer blocks is approximately equal to said offset amount minus the sash member to frame height difference, plus a clearance amount.

21. The stop of claim 1, wherein said housing comprises first and second side wall portions connected by a top wall portion, said first and second side wall portions being roughly parallel to each other and being separated to create said cavity.

22. The stop of claim 21, wherein said pivotal mounting of said tumbler comprises a pin protruding from each of a first side and a second side of said tumbler; and wherein said pins of said tumbler are pivotally received in a respective orifice in said first and second side wall portions of said housing.

23. The stop of claim 22, wherein said tumbler first end further comprises a button integral to said tumbler, said button protruding out from said first opening in said housing top end.

24. The stop of claim 23, wherein said mounting flange protrudes out from said housing at a position between said top end and said bottom end of said housing; and wherein said mounting flange is at a non-orthogonal angle to said first and second side walls of said housing.

25. A stop, for use in attachment to a frame that supports a sliding sash member, to thereon be configured to limit travel of the sash member between a closed position and a partially open position, said partially open position being a sash member position between the closed position and a full open position, said stop comprising;

a housing;

a tumbler, said tumbler comprising a first end and a second end; said tumbler being pivotally mounted to said housing; said tumbler second end comprising a bearing surface, said bearing surface transitioning into a curved surface, said curved surface terminating at an apex;

a biasing member, said biasing member being configured to bias said tumbler second end to pivot outward from a cavity in said housing into an extended position, said tumbler configured for said outward pivotal travel to be limited to said extended position by contact between a push-button portion of said tumbler proximate to its first end and a portion of said housing; a portion of said biasing member being configured to selectively contact one or more contoured features on said housing and to engage a portion of said one or more contoured features during said pivotal movement of said tumbler to also releasably limit said outward pivotal travel of said tumbler to a partially extended position, said partially extended position comprising a position where a portion of said curved surface of said tumbler protrudes out from said housing; said tumbler configured to be manually actuated out of said partially extended position by actuation of said second end of said tumbler, to thereby permit said biasing into said extended position, after said actuation ends; wherein when said tumbler is in said extended position, said bearing surface is positioned to limit movement of the sash member between the closed position and the partially opened position; and wherein when said tumbler is in said partially extended position, said tumbler is positioned to permit movement of the sash member between the partially open position and the full open position, by contact of the sash member with said curved surface to thereby cause pivotal movement of said tumbler into a partially retracted position, to result in disengagement of said portion of said biasing member from said portion of said one or more contoured features of said housing, with said tumbler being automatically biased back into said extended position when the sash member is moved back to the partially opened position or back to the closed position or back to any position between the partially open position and the closed position, said partially retracted position comprising a position where a substantial portion of said curved surface of said tumbler second end is positioned within said housing cavity; and a mounting flange, said mounting flange extending from a wall of said housing and comprising a means to mount said stop.

26. The stop of claim 25, wherein said tumbler is configured to pivot at a point between said first end and said second end of said tumbler; and wherein said tumbler first end is configured to protrude from a first opening in said housing to thereby be actuated to cause said tumbler to toggle between said extended position and a fully retracted position, said fully retracted position being a position where said tumbler is positioned completely within said housing cavity.

27. The stop of claim 26, wherein said tumbler is configured to be toggled from said extended position to said partially extended position by said tumbler initially being actuated to pivot from said extended position to said fully retracted position; and wherein when said tumbler first end is subsequently no longer being actuated, said portion of said biasing member in said selective contact with said one or more contoured features of said housing being configured to move into said engaged position with said portion of said one or more contoured features for said limited outward pivotal travel of said tumbler at said partially extended position.

28. The stop of claim 27, wherein said tumbler is configured to be toggled from said partially extended position to said extended position by said tumbler initially being actuated to pivot from said partially extended position to said fully retracted position, with said portion of said biasing member and said one or more contoured features of said housing being configured to thereby permit movement of said portion of said biasing member out of said engaged position, to no longer limit said outward pivotal travel of said tumbler to said partially extended position; and wherein when said tumbler first end is subsequently no longer being actuated, said tumbler is biased back to said extended position.

29. The stop of claim 28, wherein said biasing member is configured to be mounted to said stop to have a first arm of said biasing member extend therefrom, to be secured to said tumbler, and to have a second arm of said biasing member also extend therefrom, with an end of said second arm configured to engage said portion of said one or more contoured features on said housing in said selective contact during said pivotal movement.

30. The stop of claim 29, wherein said stop further comprises a spacer block, said spacer block being configured to be removably attached to a bottom surface of said mounting flange, said spacer block having a thickness to adjust for a height difference between the sash member and the supporting frame; and wherein said spacer block has a top surface and at least a portion of said top surface removably attaches to said bottom surface of said mounting flange by said top surface of said spacer block comprising one or more posts, and said mounting flange bottom surface comprising one or more respective orifices, said one or more posts being releasably received in said respective orifices by a sliding friction fit.

31. The stop of claim 30, wherein said spacer block further comprises one or more orifices on a bottom surface for releasably receiving one or more respective posts of a second spacer block, said second spacer block being of a thickness different than said thickness of said first spacer block.

32. A stop, for use in limiting travel of a sash member of a sash window or a sash door, by attachment onto the sash window/door master frame during manufacturing of the sash window/door assembly or by attachment onto a sash window/door frame being already manufactured and used in service, said stop being thereon capable of limiting sash travel between a closed position and a partially open position, the partially open position being a sash member position between the closed sash position and a full-open sash member position, said stop comprising;

a housing, said housing comprising one or more walls to create a cavity therein;

a tumbler, said tumbler comprising a first end and a second end; said tumbler being pivotally mounted in said housing cavity, said tumbler second end comprising a bearing surface, said bearing surface transitioning into a curved surface;

a biasing member, said biasing member being configured to bias said second end of said tumbler to pivot outward from said housing, said biased pivotal travel of said tumbler configured to normally be limited to a first position or a second position, said tumbler being biased and limited to said first position by contact between a push-button portion of said tumbler proximate to its first end, and a portion of said housing; and said tumbler being biased to be releasably limited to said second position by a portion of said biasing member being configured to selectively contact one or more contoured features on said housing and to engage a portion of said one or more contoured features during said pivotal movement of said tumbler, said second position comprising a position where a portion of said curved surface of said tumbler protrudes out from said housing; said second end of said tumbler configured to be manually actuated for said tumbler to be actuated out from said second position, to thereby permit said biasing into said first position, after said actuation ends;

wherein when said tumbler is in said first position, said bearing surface of said tumbler is positioned to limit movement of the sash member between the closed position and the partially open position; and wherein when said tumbler is in said second position, said tumbler is positioned to permit further movement of the sash member to the full-open position, by contact of the sash member with said curved surface of said tumbler to thereby cause pivotal movement of said tumbler into a partially retracted position, to result in disengagement of said portion of said biasing member from said portion of said one or more contoured features of said housing, with said tumbler being automatically biased back into said first position when the sash member is moved back to the partially opened position or back to the closed position or back to any position between the partially open position and the closed position; and a mounting flange, said mounting flange protruding outward from said housing, and comprising a means to mount said stop, said mounting flange and said means to mount said stop configured to permit said stop to be adjustably mounted to an exterior surface of the master frame.

33. The stop of claim 32, wherein said tumbler is configured to pivot at a point between said first end and said second end of said tumbler; and wherein said tumbler first end is configured to protrude from a first opening in said housing to thereby be actuated to cause said tumbler to toggle between said first position and a fully retracted position, said fully retracted position being a position where said tumbler is positioned completely within said housing cavity.

34. The stop of claim 33, wherein said tumbler is configured to be toggled from said first position to said second position by said tumbler initially being actuated to pivot from said first position to said fully retracted position; and wherein when said tumbler first end is subsequently no longer being actuated, said portion of said biasing member in said selective contact with said one or more contoured features of said housing being configured to move into said engaged position with said portion of said one or more contoured features to limit said outward pivotal travel of said tumbler to said second position.

35. The stop of claim 34, wherein said tumbler is configured to be toggled from said second position to said first position by said tumbler initially being actuated to pivot from said second position to said partially retracted position, with said portion of said biasing member and said one or more contoured features of said housing being configured to thereby permit movement of said portion of said biasing member out of said engaged position to no longer limit said outward pivotal travel of said tumbler to said second position; and wherein when said tumbler first end is subsequently no longer being actuated, said tumbler is biased back to said first position.

36. The stop of claim 35, wherein said biasing member is configured to be mounted to said stop to have a first arm of said biasing member extend therefrom, to be secured to said tumbler, and to have a second arm of said biasing member also extend therefrom, with an end of said second arm configured to engage said portion of said one or more contoured features on said housing in said selective contact during said pivotal movement of said tumbler.

37. The stop of claim 36, wherein said biasing member comprises a torsion spring, said torsion spring comprising a helical coil with said first and second arms extending therefrom; and wherein said helical coil of said biasing member is configured to be mounted to said tumbler to have said first arm of said biasing member extend therefrom and be secured to said tumbler, and wherein said portion of said biasing member configured to selectively engage said one or more contoured features on said housing comprises a post at said end of said second arm.

38. The stop of claim 37, wherein said selective engagement of said post of said biasing member with said portion of said one or more contoured features of said housing comprises guided post movement from a position "A" to a position "C"; said position "A" being a position at which said outward pivotal tumbler movement is limited to said first position of said tumbler by a portion of said first end of said tumbler contacting a portion of said housing; and said position "C" being a position at which said outward pivotal tumbler movement is limited to said second tumbler position by said post being engaged within a curved vertical face of said one or more contoured features of said housing.

39. The stop of claim 38, wherein said guided movement of said post from position "A" to position "C" comprises movement of said post up an inclined surface and over a first vertical face to a position "B", said position "B" being a post position beyond said first vertical face and corresponding to said tumbler retracted position as a result of said toggling of said tumbler first end; and wherein when said tumbler first end is no longer being toggled, biasing of said tumbler causes said post to move back towards position "A" and contact said first vertical face, said first vertical face guiding movement of said post away from position "A" and down a second vertical face to be in position "C," said first vertical face transitioning into said curved vertical face.

40. The stop of claim 39, wherein said selective contact of said post with said one or more contoured features of said housing comprises further guided movement, said further guided movement comprising movement from said position "C" back to said position "A"; said further guided movement from position "C" to position "A" comprising movement of said post over a third vertical face and down a second inclined surface into a position "D," said position "D" being a post position corresponding to said tumbler retracted position resulting from further toggling of said tumbler first end; and wherein when said first end is no longer being toggled, biasing of said tumbler causes said post to move up said second inclined surface and down a fourth vertical face to be in said position "A," said third vertical surface guiding movement of said post away from said position "C" and toward said position "A."

41. The stop of claim 29, wherein said biasing member comprises a torsion spring, said torsion spring comprising a helical coil with said first arm and said second arm extending therefrom; and wherein said helical coil and said first arm of said torsion spring are secured to said tumbler, and wherein said portion of said biasing member configured to selectively engage said one or more contoured features on said housing comprises a post at said end of said second arm.

42. The stop of claim 41, wherein said selective engagement of said post of said biasing member with said one or more contoured features of said housing comprises said one or more contoured features being configured to guide movement of said post from a position "A" to a position "C"; said position "A" being a position at which said outward pivotal tumbler movement is limited at said extended position by said portion of said first end of said tumbler contacting said portion of said housing; and said position "C" being a position at which said outward pivotal tumbler movement is limited to said partially extended position by said post nesting within a curved vertical face of said one or more contoured features.

43. The stop of claim 42, wherein said guided movement from said position "A" to said position "C" comprises movement of said post up an inclined surface and over a first vertical face to a position "B", said position "B" being a post position beyond said first vertical face and corresponding to said fully retracted position of said tumbler resulting from said initial actuation of said tumbler; and wherein when said tumbler first end is subsequently no longer being actuated, said biasing of said tumbler causes said post to move back towards position "A" and contact said first vertical face, said first vertical face guiding movement of said post away from position "A" and down a second vertical face to be in position "C," said first vertical face transitioning into said curved vertical face.

44. The stop of claim 43, wherein said selective engagement of said post of said biasing member with said one or more contoured features of said housing comprises further guided movement, said further guided movement comprising movement from said position "C" back to said position "A"; said further guided movement from said position "C" to said position "A" comprising movement of said post over a third vertical face and down a second inclined surface into a position "D," said position "D" being a post position corresponding to said fully retracted position of said tumbler after said initial tumbler actuation at said partially extended position; and wherein when said tumbler first end is subsequently no longer being actuated, biasing of said tumbler causes said post to move up said second inclined surface and down a fourth vertical face to be in said position "A," said third vertical surface guiding movement of said post away from said position "C" and toward said position "A."

45. The stop of claim 32, wherein said stop further comprises a spacer block, said spacer block having a thickness configured to adjust for variations in a height difference between the sliding sash member and the master frame; said spacer block configured to be removably attached to a bottom surface of said mounting flange, said spacer block configured with a thickness to adjust for a height difference between the sash member and the master frame; and wherein said spacer block has a top surface, with at least a portion of said top surface configured to removably attach to said bottom surface of said mounting flange by said top surface of said spacer block comprising one or more posts, and said mounting flange bottom surface comprising one or more respective orifices, said one or more posts being releasably received in said respective orifices by a sliding friction fit and the master frame.

* * * * *